US010755622B2

(12) United States Patent
Kong et al.

(10) Patent No.: US 10,755,622 B2
(45) Date of Patent: Aug. 25, 2020

(54) DISPLAY DRIVER INTEGRATED CIRCUIT FOR SUPPORTING LOW POWER MODE OF DISPLAY PANEL

(71) Applicant: Samsung Electronics Co., Ltd., Suwon-si, Gyeonggi-do (KR)

(72) Inventors: Kiho Kong, Suwon-si (KR); Hongkeun Yune, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 84 days.

(21) Appl. No.: 15/604,826

(22) Filed: May 25, 2017

(65) Prior Publication Data

US 2018/0053463 A1 Feb. 22, 2018

(30) Foreign Application Priority Data

Aug. 19, 2016 (KR) ..... 10-2016-0105372
Nov. 14, 2016 (KR) ..... 10-2016-0151425

(51) Int. Cl.
*G09G 3/20* (2006.01)

(52) U.S. Cl.
CPC ..... *G09G 3/2092* (2013.01); *G09G 3/20* (2013.01); *G09G 2300/0408* (2013.01); *G09G 2310/0289* (2013.01); *G09G 2310/08* (2013.01); *G09G 2330/021* (2013.01); *G09G 2330/023* (2013.01); *G09G 2330/028* (2013.01)

(58) Field of Classification Search
CPC ... G09G 2300/0408; G09G 2310/0289; G09G 2310/08; G09G 2330/021; G09G 2330/023; G09G 2330/028; G09G 3/20; G09G 3/2092; G09G 3/3696
See application file for complete search history.

(56) References Cited

U.S. PATENT DOCUMENTS 7,061,481 B2 * 6/2006 Tsuchiya ..... G09G 3/3625 315/169.1
8,035,633 B2 10/2011 Park
8,269,703 B2 9/2012 Park
8,698,854 B2 4/2014 Lee
9,041,626 B2 5/2015 Park et al.
9,135,859 B2 9/2015 Lee et al.
9,196,192 B2 11/2015 Kim
9,240,138 B2 1/2016 Seo
9,318,046 B2 4/2016 Xie
(Continued)

FOREIGN PATENT DOCUMENTS

KR 20120030771 A 3/2012
KR 20130140445 A 12/2013

*Primary Examiner* — Hong Zhou
(74) *Attorney, Agent, or Firm* — Harness, Dickey & Pierce, P.L.C.

(57) ABSTRACT

Disclosed is a display driver integrated circuit which includes a first booster that generates a first boosting voltage by boosting at least one of first and second power supply voltages, a second booster that generates the first boosting voltage or a second boosting voltage by boosting at least one of the first and second power supply voltages, a first regulator that generates a first output voltage based on at least one of the first boosting voltages generated by the first and second boosters, and a second regulator that generates a second output voltage based on the second boosting voltage.

19 Claims, 16 Drawing Sheets

(56) References Cited

U.S. PATENT DOCUMENTS

| | | | | |
|---|---|---|---|---|
| 2003/0053321 | A1* | 3/2003 | Ishiyama | G09G 3/3648 363/59 |
| 2008/0024480 | A1* | 1/2008 | Jee | G06F 1/3203 345/212 |
| 2008/0309304 | A1* | 12/2008 | Kimura | G09G 3/3696 323/299 |
| 2009/0244110 | A1* | 10/2009 | Ogura | G09G 3/3233 345/690 |
| 2011/0084953 | A1 | 4/2011 | Lee et al. | |
| 2011/0141089 | A1* | 6/2011 | Lee | G09G 3/20 345/211 |
| 2012/0044273 | A1 | 2/2012 | Park et al. | |
| 2012/0105419 | A1* | 5/2012 | Yang | G09G 3/3614 345/212 |
| 2013/0106822 | A1* | 5/2013 | Matsuo | G06F 1/3218 345/211 |
| 2014/0362042 | A1* | 12/2014 | Noguchi | G06F 3/0412 345/174 |
| 2016/0247458 | A1* | 8/2016 | Muto | G09G 3/344 |

* cited by examiner

DISPLAY DRIVER INTEGRATED CIRCUIT FOR SUPPORTING LOW POWER MODE OF DISPLAY PANEL

CROSS-REFERENCE TO RELATED APPLICATIONS

A claim for priority under 35 U.S.C. § 119 is made to Korean Patent Application Nos. 10-2016-0105372 filed Aug. 19, 2016, and 10-2016-0151425 filed Nov. 14, 2016, in the Korean Intellectual Property Office, the entire contents of each of which are hereby incorporated by reference.

BACKGROUND

Some example embodiments of the inventive concepts disclosed herein relate to an electronic device, and more particularly, to a configuration of a display driver integrated circuit supporting various modes of operation, and an operating method thereof.

In general, electronic devices, such as laptops, tablet PCs, smartphones, and wearable devices, may include a display device. The display device used in an electronic device may be implemented in various forms, and may include organic light-emitting diodes (OLED), active matrix organic light-emitting diode (AMOLED), liquid crystal display (LCD), electrophoretic display, electrowetting display, and plasma display (PDP).

A voltage that is generated by a power management circuit, such as a power management integrated circuit (PMIC), may not be sufficient to be used to drive the display device directly. Accordingly, to drive the display device, there is a desire for a display driver integrated circuit for processing (or generating) a voltage.

However, power may be unnecessarily consumed upon processing the voltage. Accordingly, there is a desire to reduce power consumption in the process of generating a voltage that the display driver integrated circuit uses to drive the display device.

SUMMARY

Example embodiments of the inventive concepts provide a display driver integrated circuit that supports various modes of operation of a display device.

According to an example embodiment of the inventive concepts, a display driver integrated circuit includes a first booster that generates a first boosting voltage by boosting at least one of first and second power supply voltages, a second booster that generates the first boosting voltage or a second boosting voltage by boosting at least one of the first and second power supply voltages, a first regulator that generates a first output voltage based on at least one of the first boosting voltages generated by the first and second boosters, and a second regulator that generates a second output voltage based on the second boosting voltage.

According to another example embodiment of the inventive concepts, an electronic device includes a display driver integrated circuit, and a display panel driven by first and second output voltages from the display driver integrated circuit. The display driver integrated circuit includes a first booster that generates a first boosting voltage by boosting at least one of first and second power supply voltages, a second booster that generates the first boosting voltage or a second boosting voltage by boosting at least one of the first and second power supply voltages, a first regulator that generates the first output voltage based on at least one of the first boosting voltages generated by the first and second boosters, and a second regulator that generates the second output voltage based on the second boosting voltage.

According to another example embodiment of the inventive concepts, a display driver integrated circuit includes a boosting circuit that generates a first boosting voltage by boosting at least one of first and second power supply voltages and generates the first boosting voltage or a second boosting voltage by boosting at least one of the first and second power supply voltages, and a regulating circuit that generates a first output voltage based on at least one of the first boosting voltages generated by the first and second boosters and generates a second output voltage based on the second boosting voltage.

According to another example embodiment of the inventive concepts, an electronic device includes a display panel configured to display an image; a power management integrated circuit configured to generate an external voltage; and a display driver integrated circuit configured to select at least one of two modes. In the first mode, the display driver integrated circuit is configured to provide a first output voltage to the display panel and the power management integrated circuit is configured to provide the external voltage to the display panel, an absolute value of the external voltage being greater than an absolute value of the first output voltage. In the second mode, the display driver is configured to provide the first output voltage and a second output voltage to the display panel, an absolute value of the second output voltage being less than an absolute value of the first voltage and less than an absolute value of the external voltage.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Below, example embodiments of the inventive concepts may be described in detail and clearly to such an extent that an ordinary one in the art easily implements the inventive concepts.

Figure 1:
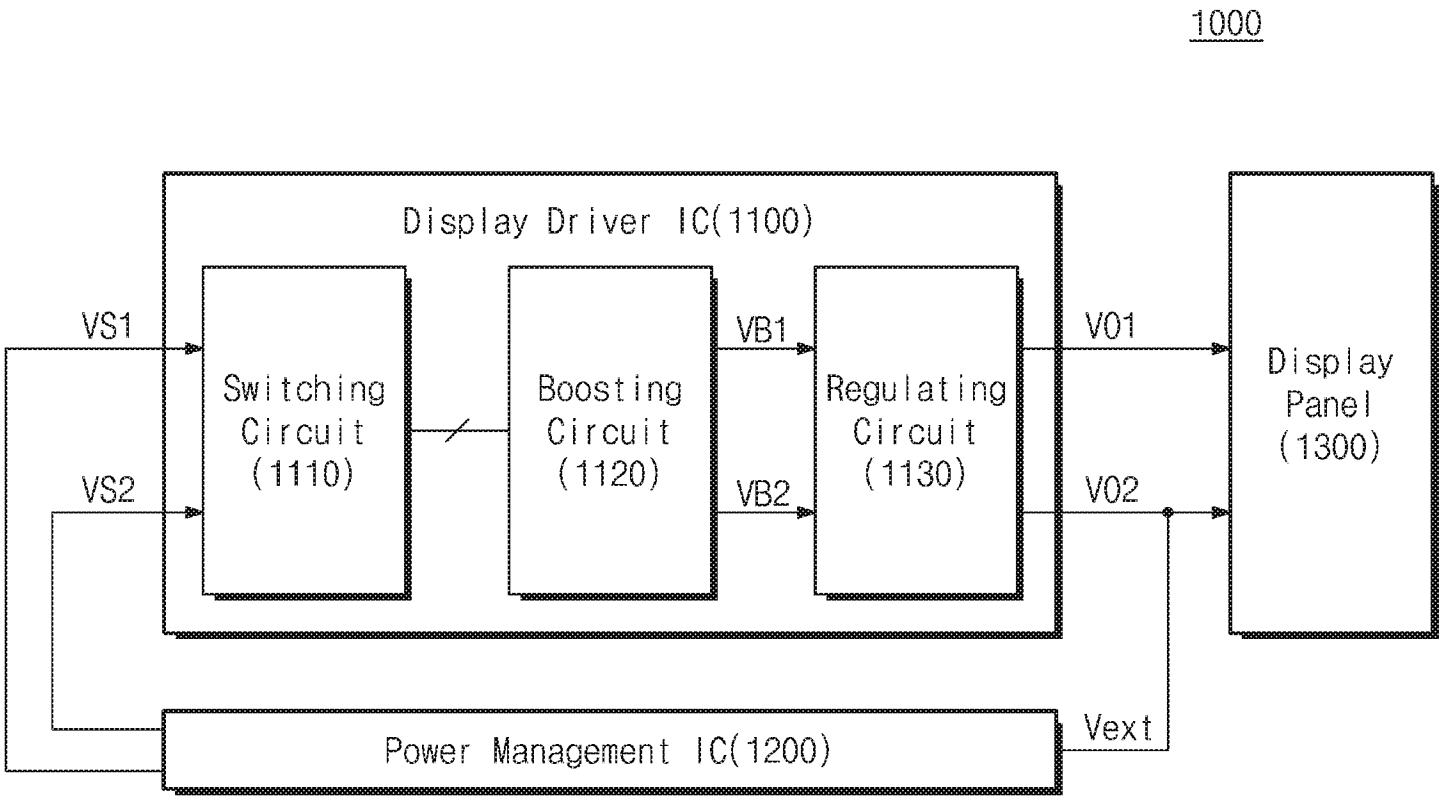
FIG. 1 is a block diagram illustrating an electronic device to which a display driver integrated circuit is applied, according to an example embodiment of the inventive concepts.

FIG. 1 is a block diagram illustrating an electronic device 1000 to which a display driver integrated circuit 1100 is applied, according to an example embodiment of the inventive concepts. Referring to FIG. 1, the electronic device 1000 may include the display driver integrated circuit 1100, a power management integrated circuit 1200, and a display panel 1300.

The display driver integrated circuit 1100 may drive the display panel 1300. For example, the display driver integrated circuit 1100 may generate a gray scale voltage corresponding to image data received from the outside, and the gray scale voltage may be output to the display panel 1300.

The display driver integrated circuit 1100 may support various operating modes in which the display panel 1300 operates in various low-power modes, as well as a normal mode. For example, when an input from a user is not received during a reference time, when a battery level of the electronic device 1000 is lower than a reference level, or when an image is displayed in only an area of the display panel 1300 or when the image includes a small amount of information (e.g., text information), the display panel 1300 may operate in a low-power mode.

The display driver integrated circuit 1100 may provide the display panel 1300 with various voltages to display an image in the display panel 1300. For example, a second output voltage VO2 illustrated in FIG. 1 may be a voltage that is used in the low-power mode of the display panel 1300. For brevity of description and illustration, two output voltages VO1 and VO2 are illustrated in FIG. 1 as being supplied from the display driver integrated circuit 1100 to the display panel 1300, but the inventive concepts are not limited thereto.

The display driver integrated circuit 1100 may include a switching circuit 1110, a boosting circuit 1120, and a regulating circuit 1130 to generate various output voltages VO1 and VO2 to be supplied to the display panel 1300.

The switching circuit 1110 may select at least one of power supply voltages VS1 and VS2 received from the outside, and the selected power supply voltage may be supplied to the boosting circuit 1120. According to various modes of operation, only one power supply voltage VS1 or VS2 may be selected or all the power supply voltages VS1 and VS2 may be selected. For brevity of description and illustration, only two power supply voltages VS1 and VS2 are illustrated in FIG. 1, but three or more power supply voltages may be supplied to the switching circuit 1110, and the inventive concepts are not limited thereto.

The boosting circuit 1120 may boost at least one received power supply voltage to generate boosting voltages VB1 and VB2. The boosting circuit 1120 may generate different boosting voltages according to a mode of operation of the electronic device 1000. For example, in the normal mode, the boosting circuit 1120 may generate the first boosting voltage VB1. In the low-power mode, the boosting circuit 1120 may generate the first and second boosting voltages VB1 and VB2. For example, each of the boosting voltages VB1 and VB2 may be a negative voltage, and an absolute value of the first boosting voltage VB1 may be larger than an absolute value of the second boosting voltage VB2.

The regulating circuit 1130 may generate the output voltages VO1 and VO2, of which levels are appropriate to drive the display panel 1300, based on the first power supply voltage VS1 from the outside and the boosting voltages VB1 and VB2. For example, the regulating circuit 1130 may include linear regulators such as low dropout (LDO) regulators. For example, each of the output voltages VO1 and VO2 may be a negative voltage, and an absolute value of the first output voltage VO1 may be larger than an absolute value of the second output voltage VO2. For example, a component that generates the first output voltage VO1 may be driven by the first power supply voltage VS1 and the first boosting voltage VB1, and a component that generates the second output voltage VO2 may be driven by the first power supply voltage VS1 and the second boosting voltage VB2. For brevity of description and illustration, an example embodiment is illustrated in FIG. 1 as the regulating circuit 1130 generates only two output voltages. However, example embodiments of the inventive concepts may not be limited thereto.

The regulating circuit 1130 may generate different output voltages according to different modes of operation of the electronic device 1000. For example, in the normal mode, the regulating circuit 1130 may generate the first output voltage VO1 but may not generate the second output voltage VO2. In the normal mode, the display panel 1300 may be driven by the first output voltage VO1 and an external voltage Vext that is separately generated by the power management integrated circuit 1200.

In contrast, in the low-power mode, the regulating circuit 1130 may generate the first and second output voltages VO1 and VO2. In the low-power mode, the display panel 1300 may be driven by the first and second output voltages VO1 and VO2, and the power management integrated circuit 1200 may not generate the external voltage Vext.

A separate controller that is provided in the display driver integrated circuit 1100 or on the outside thereof may execute an operation of selecting, at the switching circuit, any one of a plurality of power supply voltages VS1 and VS2 according to various modes of operation, an operation of generating, at the boosting circuit 1120, various level of boosting voltages, an operation of generating, at the regulating circuit 1130, various level of output voltages, and an operation of generating, at the power management integrated circuit 1200, the external voltage Vext. For example, if the controller is provided on the outside of the display driver integrated circuit 1100, the controller may be a timing controller that controls overall operations of the display driver integrated circuit 1100.

The power management integrated circuit 1200 may generate power supply voltages (e.g., VS1 and VS2) to drive the display driver integrated circuit 1100. The power management integrated circuit 1200 may generate the external voltage Vext to drive the display panel 1300 in the normal mode. For example, the power management integrated circuit 1200 may include a voltage converter (not illustrated) that generates a voltage of which a level is appropriate to drive the display driver integrated circuit 1100. Alternatively, the voltage converter may be provided as an independently separated circuit, not provided in the power management integrated circuit 1200.

The display panel 1300 may include a plurality of pixels. The output voltages VO1 and VO2 from the regulating circuit 1130 may drive the display panel 1300. The display panel 1300 may output the gray scale voltage corresponding to image data.

Meanwhile, in an example embodiment of the inventive concepts, that the boosting circuit 1120 generates the separate boosting voltage VB2 in the low-power mode may be associated with power consumption and efficiency of the display driver integrated circuit 1100. In general, some (certain, particular, or the like) voltage drop may occur in a regulating process of the regulating circuit 1120. For example, the first boosting voltage VB1 from the boosting circuit 1120 and the output voltages VO1 and VO2 from the regulating circuit 1130 may be negative in level. Accordingly, the absolute value of the first boosting voltage VB1 is the largest, and the absolute value of the second output voltage VO2 is the smallest. If the regulating circuit 1130 generates the second output voltage VO2 by using the first boosting voltage VB1 in the low-power mode, undesirable or excessive boosting of the boosting circuit 1120 may occur. In addition, since the regulating circuit 1130 generates an output voltage by using an excessively boosted voltage, the power consumption of the regulating circuit 1130 may increase.

Accordingly, to solve the issues, the boosting circuit 1120 of the display driver integrated circuit 1100 generates the separate boosting voltage VB2 in the low-power mode. For example, in the low-power mode, the boosting circuit 1120 may not only generate the first boosting voltage VB1 used to generate the first output voltage VO1, but the boosting circuit may also generate the second boosting voltage VB2 used to generate the second output voltage VO2. For example, the second boosting voltage VB2 may be a negative voltage, and an absolute value of the second boosting voltage VB2 may be smaller than an absolute value of the first boosting voltage VB1.

According to the above-described configuration, in the low-power mode, there is no need for excessive boosting to generate the output voltage VO2 for driving the display panel 1300. Accordingly, the inventive concepts may afford or accommodate a prevention of or a reduction of an increase of power consumption of the regulating circuit 1130.

Figure 2:
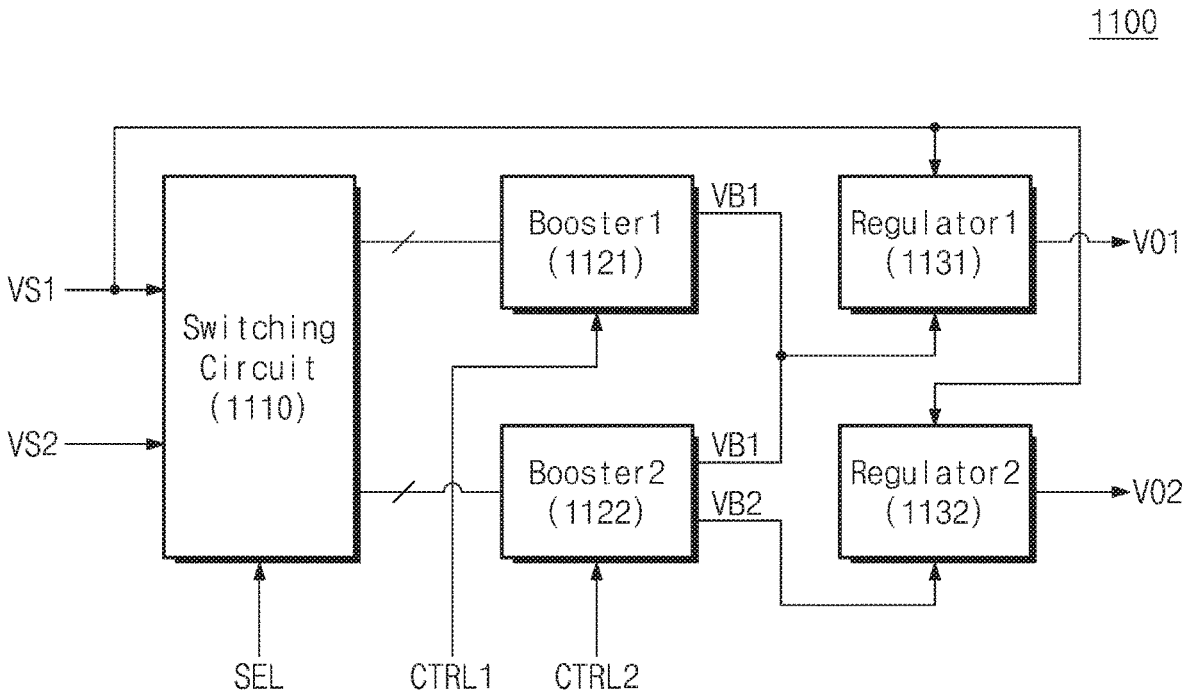
FIG. 2 is a block diagram illustrating the display driver integrated circuit illustrated in FIG. 1, according to an example embodiment of the inventive concepts.

FIG. 2 is a block diagram illustrating the display driver integrated circuit 1100 illustrated in FIG. 1. The display driver integrated circuit 1100 may include the switching circuit 1110, a first booster 1121, a second booster 1122, a first regulator 1131, and a second regulator 1132.

In an example embodiment, a configuration in which the boosting circuit 1120 illustrated in FIG. 1 generates the first boosting voltage VB1 may be implemented with the first booster 1121. Also, a configuration in which the boosting circuit 1120 illustrated in FIG. 1 generates the first boosting voltage VB1 or the second boosting voltage VB2 may be implemented with the second booster 1122.

In an example embodiment, a configuration in which the regulating circuit 1130 illustrated in FIG. 1 generates the first output voltage VO1 may be implemented with the first regulator 1131. Also, a configuration in which the regulating circuit 1130 illustrated in FIG. 1 generates the second output voltage VO2 may be implemented with the second regulator 1132.

Overall operations of the switching circuit 1110, the boosting circuit 1120, and the regulating circuit 1130 illustrated in FIG. 1 are described with reference to FIG. 1, and a duplicated description is thus omitted.

The first booster 1121 may generate the first boosting voltage VB1 by using at least one the power supply voltages VS1 and VS2. The power supply voltages VS1 and VS2 may be selected by the switching circuit 110. For example, the first booster 1121 may generate the first boosting voltage VB1 in the low-power mode as well as the normal mode. Such an operation may be executed by a control signal CTRL1.

The second booster 1122 may generate the first boosting voltage VB1 or the second boosting voltage VB2 by using at least one of the power supply voltages VS1 and VS2. The power supply voltages VS1 and VS2 may be selected by the switching circuit 110. For example, in the normal mode, the first booster 1121 may generate the first boosting voltage VB1 used for the first regulator 1131 to generate the first output voltage VOL. However, according to an example embodiment, the first booster 1121 may not operate in the normal mode. For example, in the low-power mode, the second booster 1122 may generate the second boosting voltage VB2 used for the second regulator 1132 to generate the second output voltage VO2. The operation may be executed by a control signal CTRL2. An absolute value of the second boosting voltage VB2 may be smaller than an absolute value of the first boosting voltage VB1.

Each of the first boosters 1121 and 1122 may be implemented with a charge pump, a switched mode power supply (SMPS), and/or a combination thereof. However, configurations of the boosters 1121 and 1122 may not be limited thereto. The boosters 1121 and 1122 may include various configurations that accommodate a boosting of an input voltage to a specific level and generate a negative voltage by inverting the voltage of the specific level.

Although not illustrated in FIG. 2, a stabilization capacitor may be further provided between a ground node, and a node through which the first boosting voltage VB1 is output from the first booster 1121. Also, stabilization capacitors may be further provided between the ground node and nodes through which the boosting voltages VB1 and VB2 are output from the second booster 1122. The stabilization capacitors may assist to allow the voltages VB1 and VB2 to be more stably supplied to the regulators 1131 and 1132.

Figure 3:
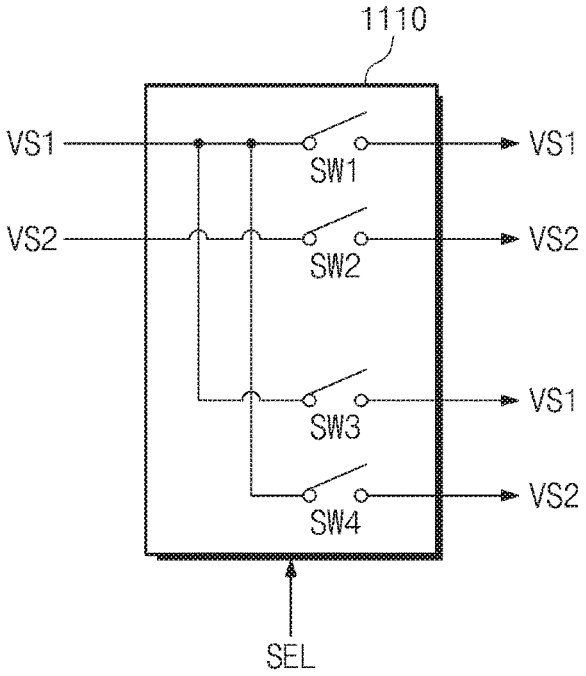
FIG. 3 is a block diagram illustrating a configuration of a switching circuit illustrated in FIG. 2.

FIG. 3 is a block diagram illustrating a configuration of the switching circuit 1110 illustrated in FIG. 2. The switching circuit 1110 may be controlled such that at least one of a plurality of power supply voltages VS1 and VS2 is supplied to the boosters 1121 and 1122. For example, the switching circuit 1110 may be composed of a plurality of switches controlled by a selection signal SEL. For example, the selection signal SEL may be generated by a separate controller that is provided in the display driver integrated circuit 1100 or on the outside thereof.

For example, the switching circuit 1110 may be composed of a plurality of transistors that are turned on or off by the selection signal SEL. Alternatively or additionally, the switching circuit 1110 may be implemented with a multiplexer that selects at least one power supply voltage in response to the selection signal SEL. However, a configuration of the switching circuit 1110 may not be limited thereto. The switching circuit 1110 may include various components for selecting at least one of a plurality of power supply voltages.

Operations of the switching circuit 1110 and the boosters 1121 and 1122 in normal and low-power modes will be more fully described with reference to FIGS. 2 and 3.

In the normal mode, first to fourth switches SW1 to SW4 may be switched on. In this case, each of the boosters 1121 and 1122 may generate the first boosting voltage VB1 by using the power supply voltages VS1 and VS2. Alternatively, in the normal mode, the first switch SW1 and the third switch SW3 may be only switched on. In this case, each of the boosters 1121 and 1122 may generate the first boosting voltage VB1 by using the power supply voltage VS1. Here, an absolute value of a boosting voltage generated in such a case may be smaller than an absolute value of a boosting voltage that is generated by using all the power supply voltages VS1 and VS2.

Meanwhile, in the low-power mode, there may be a desire to generate boosting voltages of different levels to prevent or mitigate unnecessary or excessive boosting of the boosting circuit 1120 (refer to FIG. 1) including the boosters 1121 and 1122. For example, the second boosting voltage VB2 generated by the second booster 1122 may be smaller than the first boosting voltage VB1 generated by the first booster 1121.

For example, in the low-power mode, only the switches SW1, SW2, and SW3 may be switched on. In this case, the first booster 1121 may generate the first boosting voltage VB1 by using the power supply voltages VS1 and VS2, and the second booster 1122 may generate the second boosting voltage VB2 by using the power supply voltage VS1. In this case, an absolute value of the second boosting voltage VB2 may be smaller than an absolute value of the first boosting voltage VB1.

For example, in another low-power mode, only the switches SW1, SW2, and SW4 may be switched on. In this case, the first booster 1121 may generate the first boosting voltage VB1 by using the power supply voltages VS1 and VS2, and the second booster 1122 may generate the second boosting voltage VB2 by using the power supply voltage VS2. In this case, an absolute value of the second boosting voltage VB2 may be smaller than an absolute value of the first boosting voltage VB1.

For example, in still another low-power mode, only the switches SW1 and SW4 may be switched on. In this case, the first booster 1121 may generate the first boosting voltage VB1 by using the power supply voltage VS1, and the second booster 1122 may generate the second boosting voltage VB2 by using the power supply voltage VS2. In this case, an absolute value of the second boosting voltage VB2 may be smaller than an absolute value of the first boosting voltage VB1.

As well as a switching operation of the switching circuit 1110 for selecting power supply voltages to be supplied to the boosters 1121 and 1122, a frequency of a clock for operating the boosters 1121 and 1122 may be adjusted. For example, in the low-power mode, a frequency of a clock for operating the second booster 1122 may be decreased by the control signal CTRL2. Besides, levels of the power supply voltages VS1 and VS2 may be changed to generate optimized boosting voltages based on various factors including a user demand, a system environment, etc.

Figure 4:
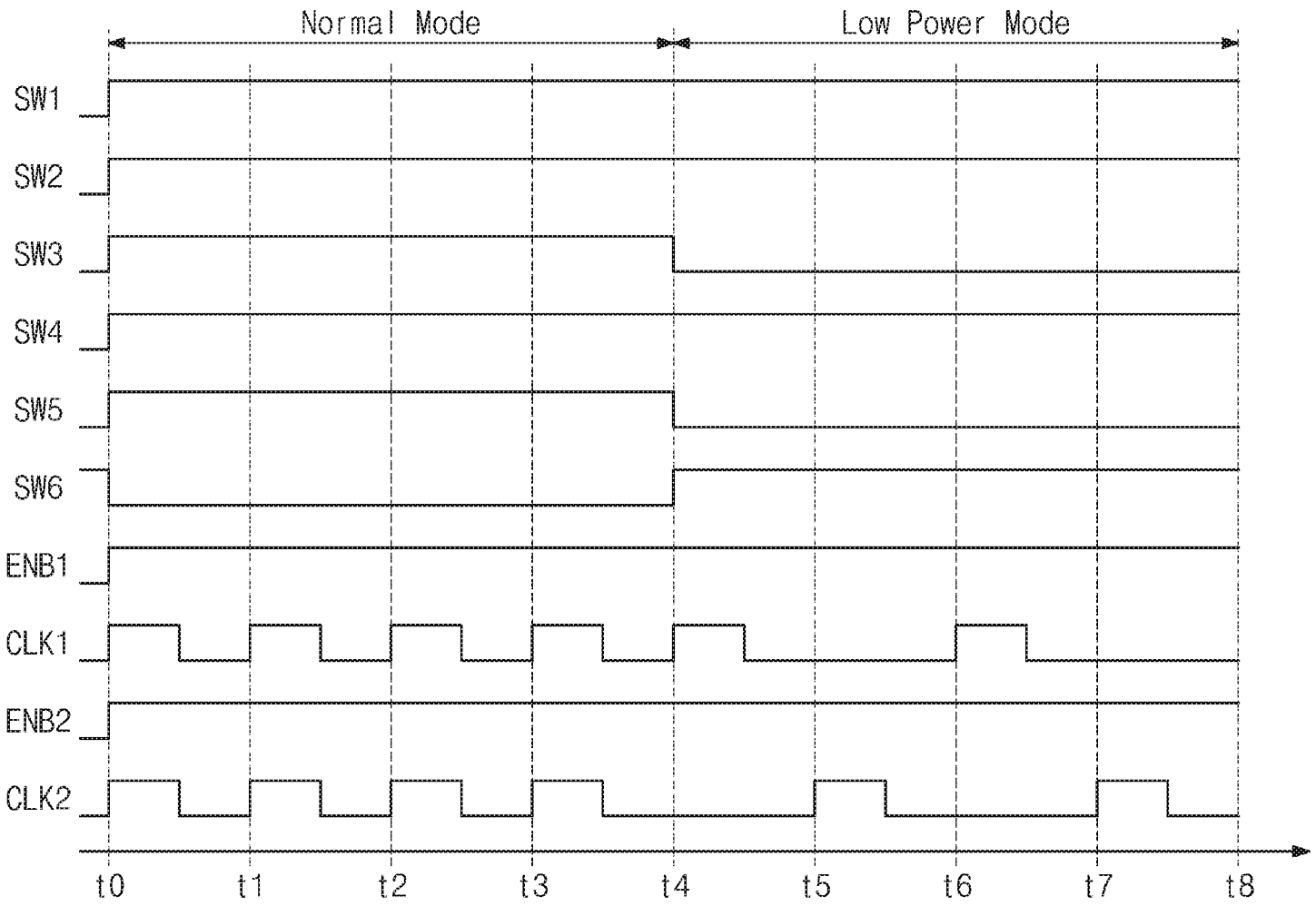
FIG. 4 is a drawing illustrating operating waveforms of switches constituting the switching circuit and waveforms of control signals for operating in any one of various low-power modes.

Operating waveforms of switches constituting the switching circuit 1110 and waveforms of the control signals CTRL1 and CTRL2 for operating the boosters 1121 and 1122 in any one of various low-power modes are illustrated in FIG. 4.

Figure 5:
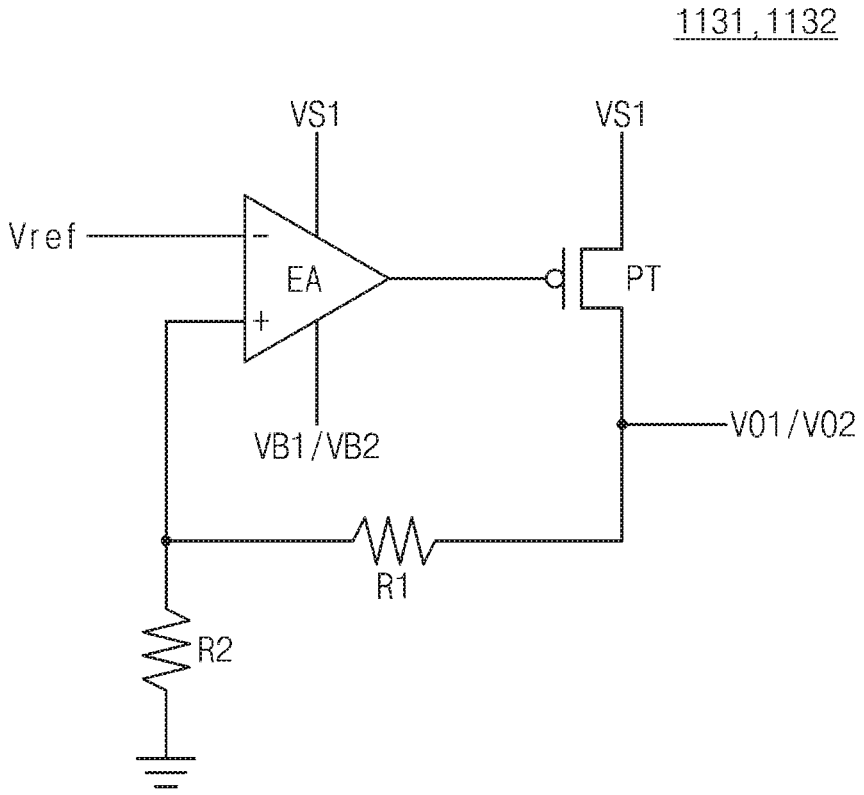
FIG. 5 is a drawing illustrating a configuration of a regulator illustrated in FIG. 2.

The control signal CTRL1 for controlling the first booster 1121 may include an enable signal ENB1 and a clock CLK1, and the control signal CTRL2 for controlling the second booster 1122 may include an enable signal ENB2 and a clock CLK2. The boosters 1121 and 1122 may be respectively activated by the enable signals ENB1 and ENB2 and may respectively perform the boosting operation in response to the clocks CLK1 and CLK2. In an example embodiment, FIG. 4 shows that in the low-power mode, the switches SW1, SW2, and SW4 are turned on. Additionally, a frequency of the first clock CLK1 for driving the first booster 1121 in the low-power mode is smaller than a frequency of the first clock CLK1 in the normal mode, and a frequency of the clock CLK2 for driving the second booster 1122 is smaller than a frequency of the first clock CLK2 in the normal mode. The first clock CLK1 may be in phase or out of phase with the second clock CLK2 in the low-power mode FIG. 5 is a circuit diagram illustrating a configuration of the regulators 1131 and 1132 illustrated in FIG. 2. For example, each of the regulators 1131 and 1132 may be a linear regulator such as an LDO regulator. However, example embodiments of the inventive concepts may not be limited thereto. For example, the regulators 1131 and 1132 may be variously changed or modified to be driven by the boosting voltages VB1 and VB2.

The regulator 1131/1132 may include an error amplifier EA, first and second resistors R1 and R2, and a pass transistor PT. A reference voltage Vref may be applied to a first input terminal of the error amplifier EA. An output terminal of the error amplifier EA may be connected to a control, or gate electrode of the pass transistor PT. The first power supply voltage VS1 may be applied to a first, or source terminal of the pass transistor PT, and the output voltage VO1/VO2 may be output through a second, or drain terminal of the pass transistor PT. The first resistor R1 may be connected between a second input terminal of the error amplifier EA and the source terminal of the pass transistor PT, and the second resistor R2 may be connected between the second input terminal of the error amplifier EA and the ground node. The pass transistor PT is shown to be a PMOS transistor, but the inventive concepts are not limited thereto.

In the first regulator 1131, the first power supply voltage VS1 may be applied to a first power terminal of the error amplifier EA independent of a mode of operation. In the first regulator 1131, the first boosting voltage VB1 may be applied to a second power terminal of the error amplifier EA independent of a mode of operation. Accordingly, the first regulator 1131 may generate the first output voltage VO1 independent of a mode of operation.

The second regulator 1132 may selectively operate based on a mode of operation. For example, the second regulator 1132 may not operate in the normal mode. The reason is that the external voltage Vext, which is separately generated by the power management integrated circuit 1200 (refer to FIG. 1), is used to drive the display panel 1300 instead of the second output voltage VO2.

In the second regulator 1132, the first power supply voltage VS1 may be applied to the first power terminal of the error amplifier EA in the low-power mode. In the second regulator 1132, the second boosting voltage VB2 may be applied to the second power terminal of the error amplifier EA. Accordingly, the second regulator 1132 may generate the second output voltage VO2 in the low-power mode.

As such, according to a configuration in which the second regulator 1132 is driven by the boosting voltage VB2 separately generated in the low-power mode, generate an excessively boosted voltage to obtain the second output voltage VO2 of a target level may not be required. Accordingly, since power consumption of the second regulator 1132 is reduced, the inventive concepts may afford a reduction of power consumption of the display driver integrated circuit 1110.

However, a configuration of the regulator 1131/1132 illustrated in FIG. 5 is only an example and is not limited thereto. Unlike a configuration illustrated in FIG. 5, for example, the first boosting voltage VB1 or the second boosting voltage VB2 may be applied to the first power terminal of the error amplifier EA of the first regulator 1131 and a drain terminal of the pass transistor PT, and the first power supply voltage VS1 may be applied to the second power terminal of the error amplifier EA of the first regulator 1131. In this case the pass transistor PT may be an NMOS transistor.

FIG. 5 describes that the second boosting voltage VB2 separately generated in the low-power mode drives the error amplifier EA of the second regulator 1132. For example, a configuration for generating the boosting voltage VB2 of which a level is different from that of the boosting voltage VB1 generated in the normal mode and a configuration in which the regulators 1131 and 1132 are respectively driven through such the configuration all may belong to the scope and spirit of the inventive concepts.

Figure 6:
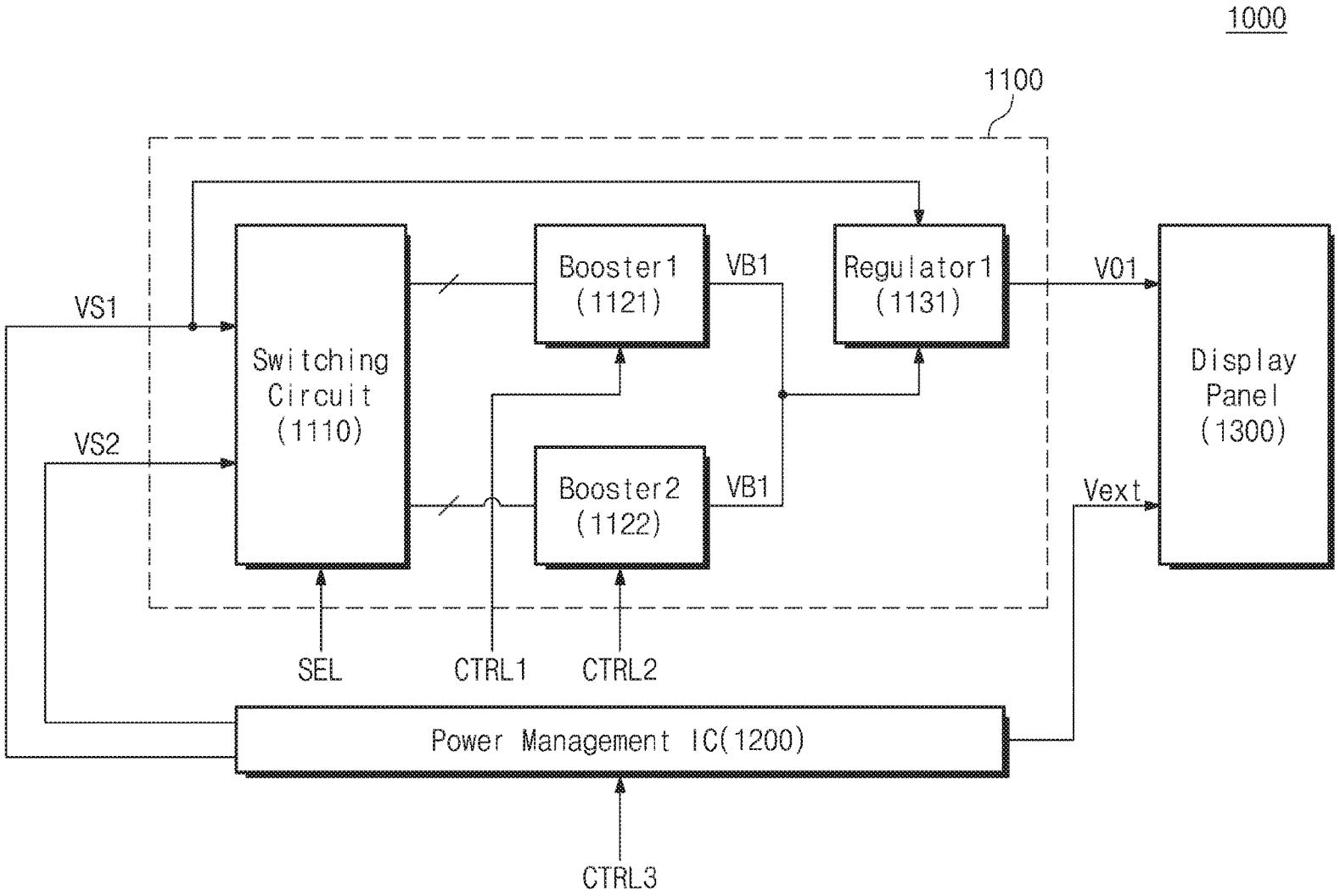
FIG. 6 is a block diagram illustrating an operation of the electronic device in a normal mode.

FIG. 6 is a block diagram illustrating an operation of the electronic device 1000 in a normal mode. In general, a significant amount of power is desired to drive the display panel 1300 in the normal mode. To this end, the switching circuit 1110 may be controlled such that the same power supply voltage is supplied to the first booster 1121 and the second booster 1122.

For example, each of the boosters 1121 and 1122 may be supplied with the power supply voltages VS1 and VS2 and may generate the first boosting voltage VB1. The operation may be controlled, for example, by the control signals CTRL1 and CTRL2.

However, according to an example embodiment, the second booster 1122 may not operate even though a current mode of operation is the normal mode. For example, the display driver integrated circuit 1100 may be set in consideration of various factors such as a brightness control of a user and a battery level of the electronic device 1000, such that only the first booster 1121 operates.

Alternatively, according to an example embodiment, even though a current mode of operation is the normal mode, each of the boosters 1121 and 1122 may be supplied with only the first power supply voltage VS1. Likewise, the switching circuit 1110 may be controlled in consideration of various factors such as a brightness control of a user and a battery level of the electronic device 1000, such that only the first power supply voltage VS1 is supplied to the boosters 1121 and 1122.

The first regulator 1131 (in more detail, the error amplifier EA of FIG. 4) may be driven by the first power supply voltage VS1 and the first boosting voltage VB1 generated by the first booster 1121. Alternatively or additionally, to generate the first output voltage VO1 stably, the first regulator 1131 may be additionally supplied with the first boosting voltage VB1 generated by the second booster 1122. For example, since a current by the first boosting voltage VB1 generated by the first booster 1121 and a current by the second boosting voltage VB2 generated by the second booster 1122 are all supplied to the first regulator 1131, the first output voltage VO1 may be generated more stably.

A voltage Vext may be generated by the power management integrated circuit 1200. The voltage Vext may be a level different from that of the first output voltage VO1, from among voltages desired to drive the display panel 1300 in the normal mode. For example, the external voltage Vext may be a negative voltage, and an absolute value of the external voltage Vext may be smaller than an absolute value of the first output voltage VO1.

For example, the power management integrated circuit 1200 may generate the external voltage Vext in response to a control signal CTRL3 in the normal mode. For example, the control signal CTRL3 may be received from a controller that is provided in the display driver integrated circuit 1100 or on the outside thereof. The power management integrated circuit 1200 may generate the first power supply voltage VS1 to generate boosting voltages VB1 and/or VB2. Also, the power management integrated circuit 1200 may generate the first power supply voltage VS1 to drive the error amplifier EA (refer to FIG. 4) of the first regulator 1131.

Figure 7:
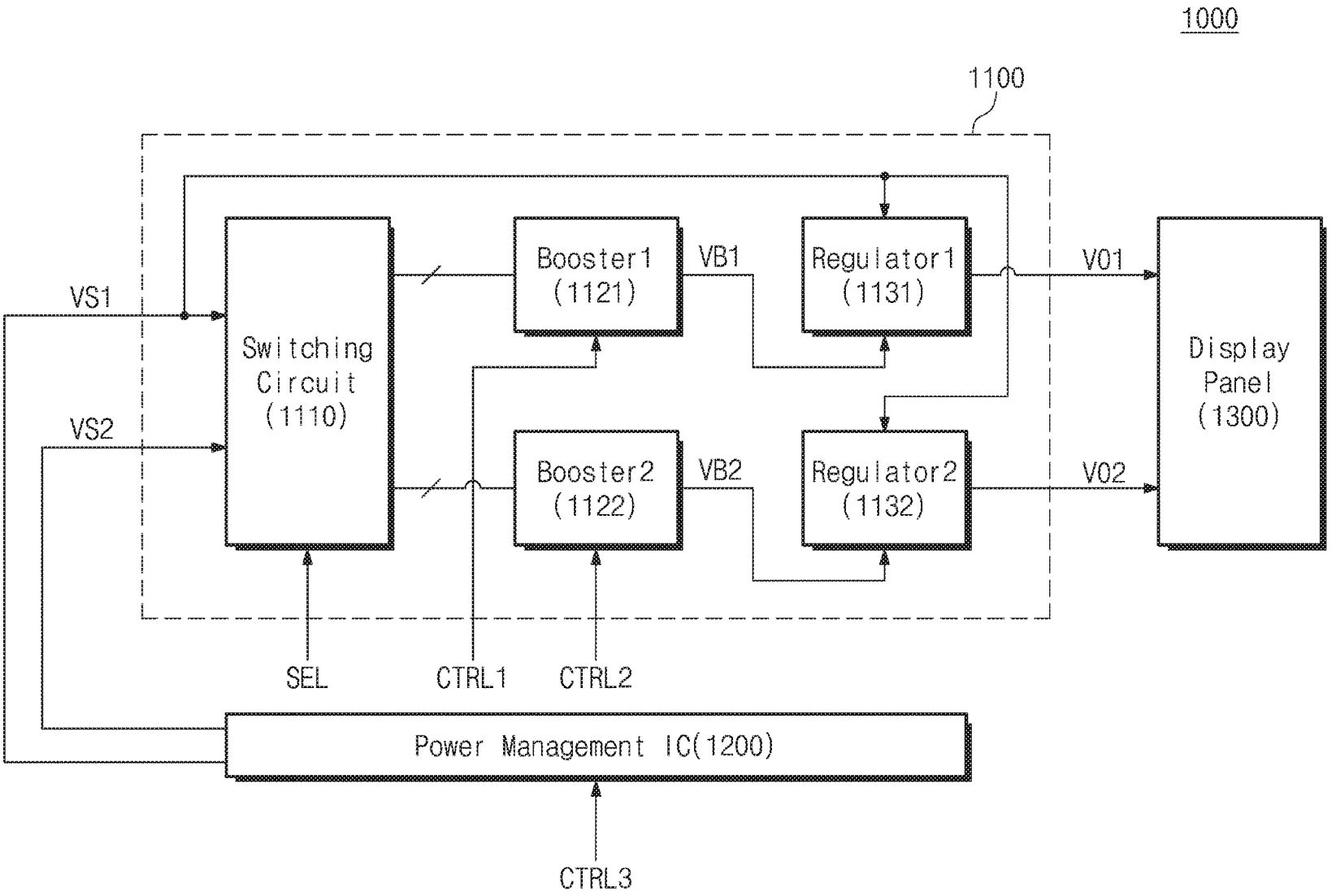
FIG. 7 is a block diagram illustrating an operation of the electronic device in a low-power mode.

FIG. 7 is a block diagram illustrating an operation of the electronic device 1000 in a low-power mode. In general, a relatively small amount of power is sufficient to drive the display panel 1300 in the low-power mode. In other words, an absolute value of the second output voltage VO2 sufficient to drive the display panel 1300 in the low-power mode may be smaller than an absolute value of the external voltage Vext used in the normal mode. Accordingly, the switching circuit 1110 may be controlled such that different power supply voltages are respectively supplied to the first booster 1121 and the second booster 1122.

For example, the first power supply voltage VS1 may be supplied to the first booster 1121 through the switching circuit 1110, and the second power supply voltage VS2 may be supplied to the second booster 1122 through the switching circuit 1110. For example, the first power supply voltage VS1 may be generated by the power management integrated circuit 1200. However, example embodiments of the inventive concepts may not be limited thereto. For example, the first power supply voltage VS1 and/or the second power supply voltage VS2 may be a voltage that is converted by a separate voltage converter, which is provided in the power management integrated circuit 1200 or on the outside thereof, to have an appropriate level, and it is sufficient if the first power supply voltage VS1 is higher in level than the second power supply voltage VS2.

The first power supply voltage VS1 and the first boosting voltage VB1 may drive the first regulator 1131 to generate the first output voltage VO1. The first power supply voltage VS1 and the second boosting voltage VB2 may drive the second regulator 1132 to generate the second output voltage VO2. For example, an absolute value of the first output voltage VO1 may be larger than an absolute value of the second output voltage VO2.

Figure 8:
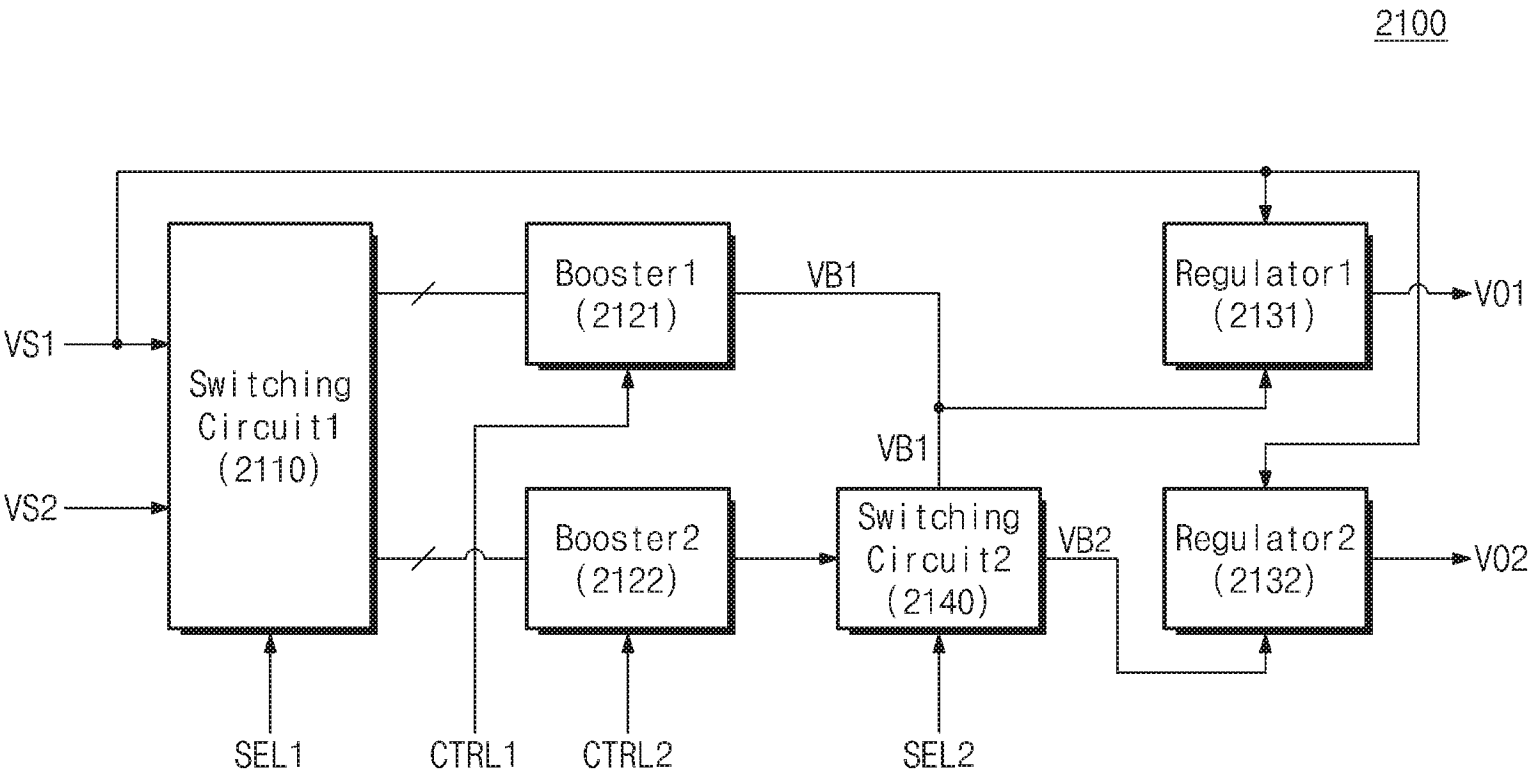
FIG. 8 is a block diagram illustrating the display driver integrated circuit illustrated in FIG. 1, according to an example embodiment of the inventive concepts.

FIG. 8 is a block diagram illustrating a display driver integrated circuit illustrated in FIG. 1, according to an example embodiment of the inventive concepts. A display driver integrated circuit 2100 may include a first switching circuit 2110, a first booster 2121, a second booster 2122, a first regulator 2131, a second regulator 2132, and a second switching circuit 2140. According to an example embodiment of the inventive concepts, the display driver integrated circuit 2100 is substantially the same or similar to the embodiment of FIG. 2 except the display driver integrated circuit 2100 further includes the second switching circuit 2140. Thus, a duplicated description thereof may not be repeated here. However, for clarity of illustration, the first switching circuit 2110 is illustrated as being controlled by a first selection signal SEL1.

The second switching circuit 2140 may be configured to selectively provide the first boosting voltage VB1 to the first regulator 2131, or the second boosting voltage VB2 to the second regulator 2132 in response to a second selection signal SEL2. For example, the second selection signal SEL2 may be generated by a separate controller that is provided in the display driver integrated circuit 2100, or on the outside thereof.

For example, in the normal mode, the second switching circuit 2140 may be controlled such that the first boosting voltage VB1 generated by the second booster 2122 is provided to the first regulator 2131. However, even though a current mode may be a normal mode, the second booster 2122 may not generate the first boosting voltage VB1 due to various factors such as a user demand and/or a system environment. In contrast, in the low-power mode, the second switching circuit 2140 may be controlled such that the second boosting voltage VB2 generated by the second booster 2122 is provided to the second regulator 2132.

Figure 9A:
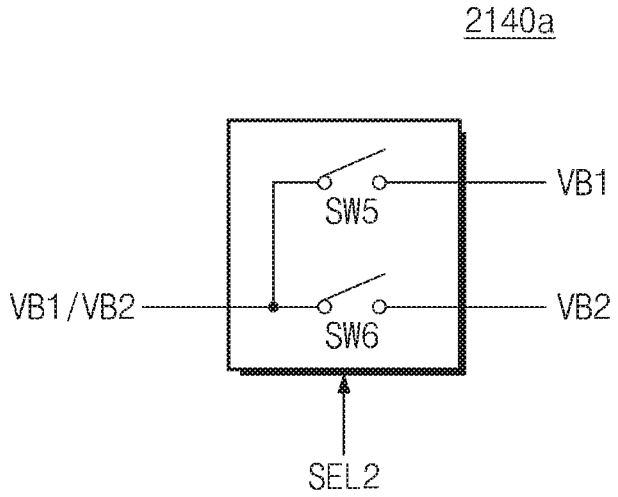
FIGS. 9A and 9B are drawings illustrating configurations of a second switching circuit illustrated in FIG. 8.
Figure 9B:
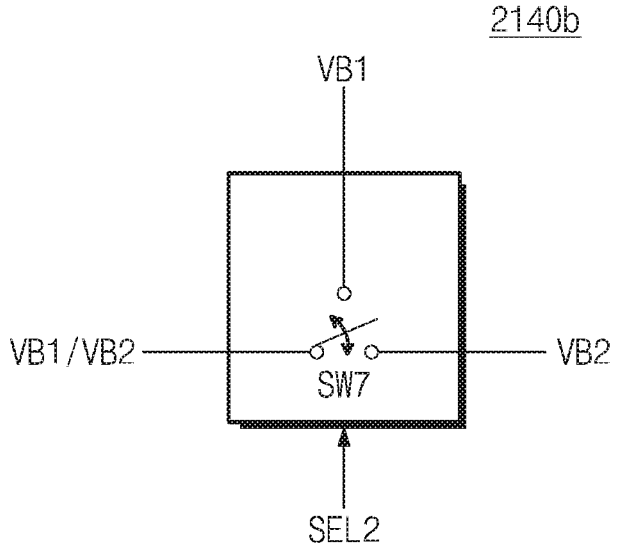

FIGS. 9A and 9B are drawings illustrating configurations of the second switching circuit 2140 illustrated in FIG. 8. Referring to FIG. 9A, a second switching circuit 2140*a* may include two switches SW5 and SW6 that are implemented with transistors, which are turned on or off by the second selection signal SEL2. For example, in the normal mode, the switch SW5 may be switched on by the second selection signal SEL2, and the switch SW6 may be switched off by the selection signal SEL2. However, even though a current mode is the normal mode, the switch SW5 may be switched off if the second booster 2122 does not need to generate the first boosting voltage VB1.

Alternatively or additionally, as illustrated in FIG. 9B, a second switching circuit 2140*b* may include one switch SW7. The switch SW7 may be configured to provide the first boosting voltage VB1 to the first regulator 2131 or the second boosting voltage VB2 to the second regulator 2132 in response to the second selection signal SEL2.

The above-described configurations of the second switching circuits 2140*a* and 2140*b* are only an example, and example embodiments of the inventive concepts may not be limited thereto. The switching circuit 2140 (refer to FIG. 8) may be variously configured to provide the first boosting voltage VB1 to the first regulator 2131 in the normal mode or the second boosting voltage VB2 to the second regulator 2132 in the low-power mode.

Figure 10:
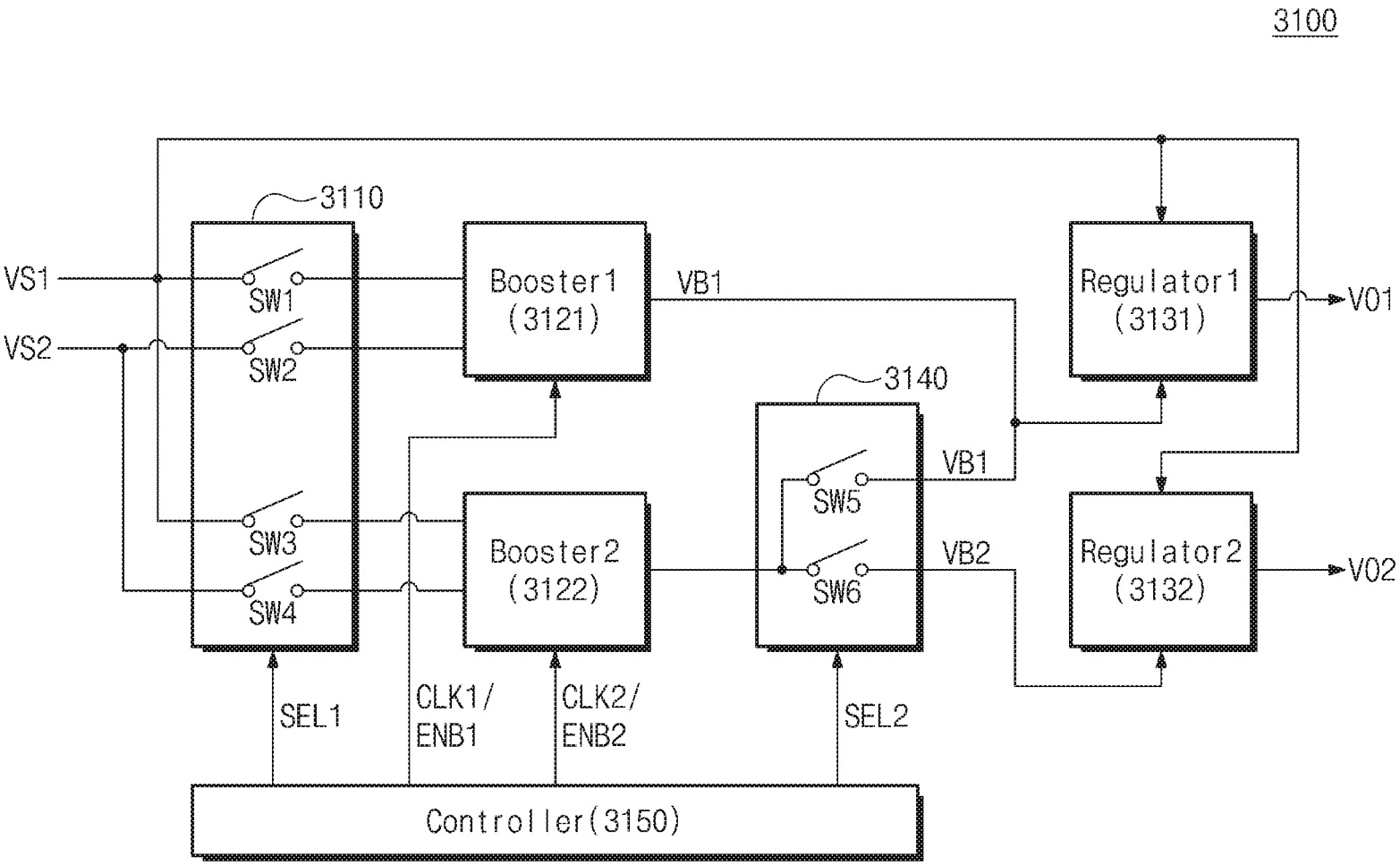
FIG. 10 is a block diagram illustrating the display driver integrated circuit illustrated in FIG. 1, according to an example embodiment of the inventive concepts.

FIG. 10 is a block diagram illustrating a display driver integrated circuit illustrated in FIG. 1, according to an example embodiment of the inventive concepts. A display driver integrated circuit 3100 may include a first switching circuit 3110, a first booster 3121, a second booster 3122, a first regulator 3131, a second regulator 3132, a second switching circuit 3140, and a controller 3150. According to an example embodiment of the inventive concepts, the display driver integrated circuit 3100 is substantially the same or similar to the embodiment of FIG. 8 except the display driver integrated circuit 3100 further includes the controller 3150. Thus, a duplicated description thereof may not be repeated here.

The controller 3150 may control a switching operation of the first switching circuit 3110, operations of the boosters 3121 and 3122 in the normal mode or the low-power mode, and a switching operation of the second switching circuit 3140. For example, the controller 3150 may generate the selection signals SEL1 and SEL2, the enable signals ENB1 and ENB2, and the clocks CLK1 and CLK2 based on a control signal from a timing controller (not illustrated).

In the normal mode, the controller 3150 may control the first switching circuit 3110 by using the first selection signal SEL1 such that the same power supply voltage is supplied to the boosters 3121 and 3122. The controller 3150 may control the second booster 3122 by using the enable signal ENB2 and the clock CLK2 such that the second booster 3122 generates the first boosting voltage VB1. The controller 3150 may control the second switching circuit 3140 by using the second selection signal SEL2 such that the first boosting voltage VB1 generated by the second booster 3122 is provided to the first regulator 3131.

In the normal mode, the display panel 1300 (refer to FIG. 1) may be driven by the first output voltage VO1 from the first regulator 3131 and the external voltage Vext generated by the power management integrated circuit 1200 (refer to FIG. 1).

In the low-power mode, the controller 3150 may control the first switching circuit 3110 by using the first selection signal SEL1 such that different power supply voltages are supplied to the boosters 3121 and 3122. The controller 3150 may control the second booster 3122 by using the enable signal ENB2 and the clock CLK2 such that the second booster 3122 generates the second boosting voltage VB2. For example, an absolute value of the second boosting voltage VB2 may be smaller than an absolute value of the first boosting voltage VB1. The controller 3150 may control the second switching circuit 3140 by using the second selection signal SEL2 such that the second boosting voltage VB2 generated by the second booster 3122 is provided to the second regulator 3132.

In the low-power mode, since the second output voltage VO2 from the second regulator 3132 is used instead of the external voltage Vext generated by the power management integrated circuit 1200 (refer to FIG. 1), the power management integrated circuit 1200 does not need to generate the external voltage Vext. Accordingly, the power management integrated circuit 1200 may not generate the external voltage Vext under control of the controller 3150. Alternatively or additionally, the operation may be executed under control of a timing controller (not illustrated).

In the low-power mode, the display panel 1300 may be driven by the first output voltage VO1 from the first regulator 3131 and the second output voltage VO2 from the second regulator 3132.

Figure 11:
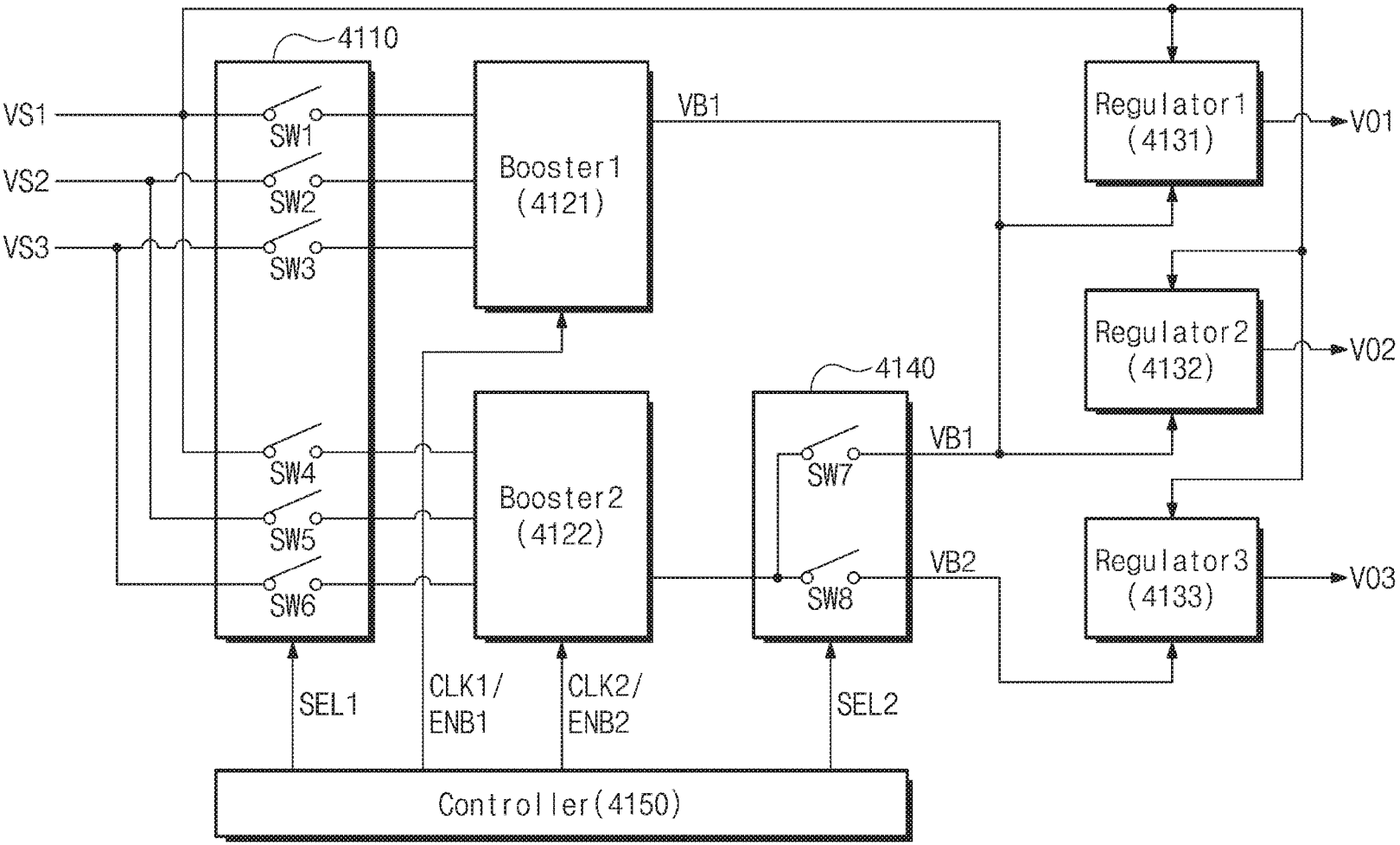
FIG. 11 is a block diagram illustrating the display driver integrated circuit illustrated in FIG. 1, according to an example embodiment of the inventive concepts.

FIG. 11 is a block diagram illustrating a display driver integrated circuit illustrated in FIG. 1, according to an example embodiment of the inventive concepts. A display driver integrated circuit 4100 may include a first switching circuit 4110, a first booster 4121, a second booster 4122, a first regulator 4131, a second regulator 4132, a third regulator 4133, a second switching circuit 4140, and a controller 4150. According to an example embodiment of the inventive concepts, the display driver integrated circuit 4100 is substantially the same or similar to the embodiment of FIG. 10 except the display driver integrated circuit 4100 receives three power supply voltages VS1 to VS3, and further includes the third regulator 4133. Thus, a duplicated description thereof may not be repeated here.

In the normal mode, the first switching circuit 4110 may be controlled such that at least one of the power supply voltages VS1 to VS3 is supplied to the boosters 4121 and 4122. For example, switches SW1 and SW4 may be switched on such that only the first power supply voltage VS1 is supplied to the boosters 4121 and 4122. Alternatively or additionally, switches SW1, SW2, SW4, and SW5 may be switched on such that the power supply voltages VS1 and VS2 are supplied to each of the boosters 4121 and 4122. However, a combination of power supply voltages to be supplied to the boosters 4121 and 4122 in the normal mode may be variously changed or modified, and example embodiments of the inventive concepts may not be limited thereto.

Meanwhile, in the normal mode, the display panel 1300 (refer to FIG. 1) may be driven by the output voltages VO1 and VO2 and the external voltage Vext generated by the power management integrated circuit 1200 (refer to FIG. 1). For example, each of the output voltages VO1 and VO2 and the external voltage Vext may be a negative voltage. In this case, an absolute value of the first output voltages VO1 may be the largest, and an absolute value of the external voltage Vext may be the smallest.

In the normal mode, each of the first and second regulators 4131 and 4132 may be driven by the first power supply voltage VS1 and the first boosting voltage VB1. Accordingly, the first and second boosting voltages VB1 and VB2 may be respectively generated by the boosters 4121 and 4122. However, a voltage drop by the second regulator 4132 may be larger than a voltage drop by the first regulator 4131. For example, an absolute value of the first output voltage VO1 may be larger than an absolute value of the second output voltage VO2. The third regulator 4133 may not operate in the normal mode. Instead, the external voltage Vext generated by the power management integrated circuit 1200 (refer to FIG. 1) may be used to drive the display panel 1300.

In the low-power mode, the first switching circuit 4110 may be controlled such that at least one of the power supply voltages VS1 to VS3 is supplied to the boosters 4121 and 4122. For example, voltages that are respectively supplied to the first booster 4121 and the second booster 4122 may be different from each other. For example, the switch SW1 may be switched on such that the first power supply voltage VS1 is supplied to the first booster 4121, and switches SW5 and SW6 may be switched on such that the second and third power supply voltages VS2 and VS3 are supplied to the second booster 4122.

However, such switching operations are only examples. For example, power supply voltages to be supplied to the boosters 4121 and 4122 may be variously combined such that an absolute value of the first boosting voltage VB1 boosted by the first booster 4121 is larger than an absolute value of the second boosting voltage VB2 boosted by the second booster 4122.

In the low-power mode, the display panel 1300 may be driven by the third output voltage VO3 generated by the third regulator 4133 instead of the external voltage Vext generated by the power management integrated circuit 1200 (refer to FIG. 1). Undesirable or excessive boosting may be prevented or mitigated because the third output voltage VO3 is generated based on the second boosting voltage VB2 of which an absolute value is smaller than an absolute value of the first boosting voltage VB1. Accordingly, since power consumption of the third regulator 4133 is reduced, the inventive concepts may afford a reduction of power consumption of the display driver integrated circuit 4100.

Figure 12:
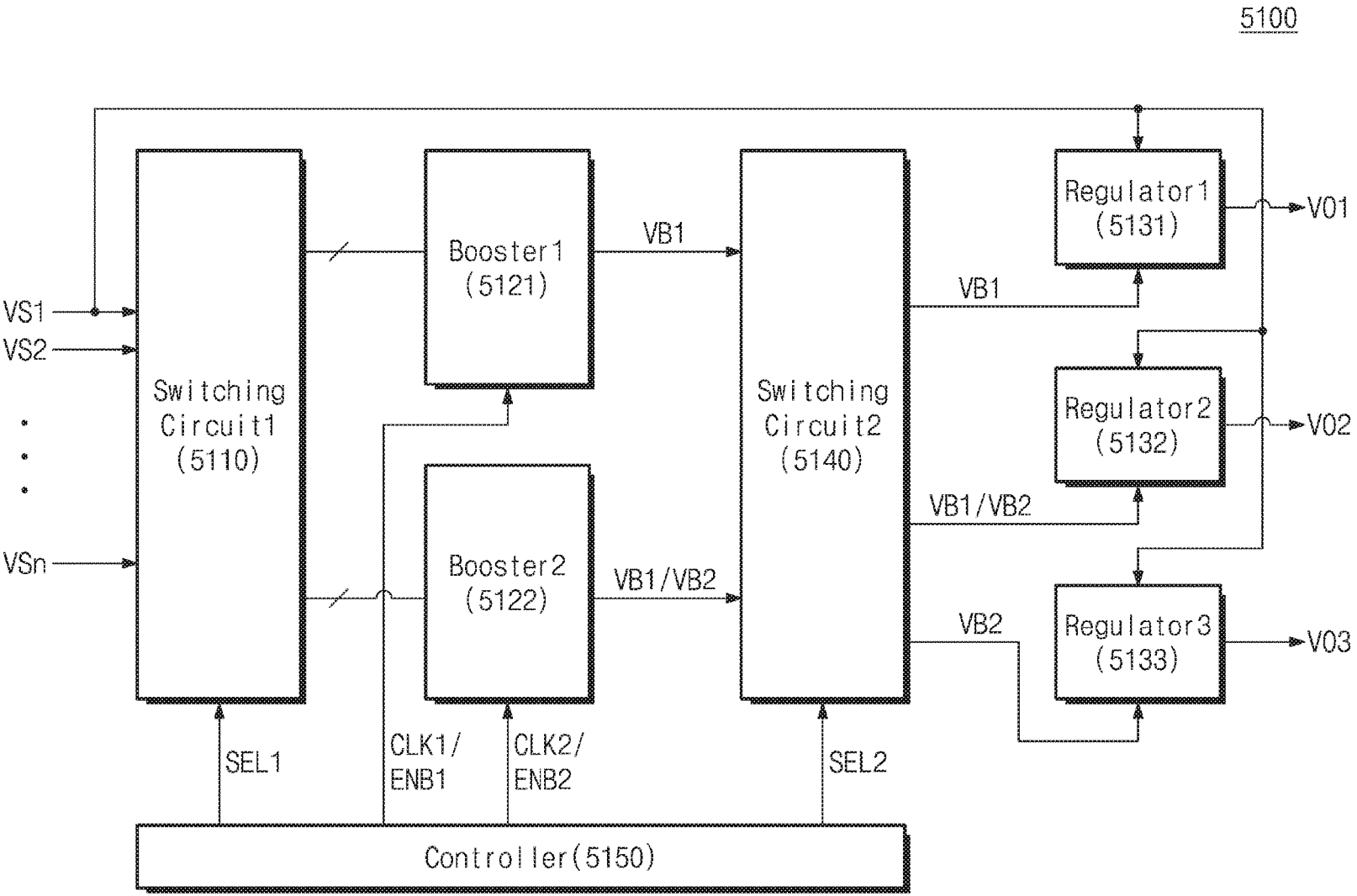
FIG. 12 is a block diagram illustrating the display driver integrated circuit illustrated in FIG. 1, according to an example embodiment of the inventive concepts.

FIG. 12 is a block diagram illustrating a display driver integrated circuit illustrated in FIG. 1, according to an example embodiment of the inventive concepts. A display driver integrated circuit 5100 may include a first switching circuit 5110, a first booster 5121, a second booster 5122, a first regulator 5131, a second regulator 5132, a third regulator 5133, a second switching circuit 5140, and a controller 5150. According to an example embodiment of the inventive concepts, the display driver integrated circuit 5100 is similar to the embodiment of FIG. 11 except the display driver integrated circuit 5100 receives a plurality of power supply voltages VS1 to VSn and except for a configuration and an arrangement of the second switching circuit 5140. Thus, a duplicated description thereof may not be repeated here.

Unlike the above-described example embodiments, the embodiment of FIG. 12 may be implemented such that a plurality of power supply voltages VS1 to VSn are supplied to the display driver integrated circuit 5100. The plurality of power supply voltages VS1 to VSn may be generated by the power management integrated circuit 1200 (refer to FIG. 1). Example embodiments assume that $|VS1|>|VS2|> \ldots >|VSn|$, however the inventive concepts are not limited thereto.

The second switching circuit 5140 may be configured to provide various boosting voltages to the regulators 5131 to 5133 by using the boosting voltages VB1 and VB2 based on various modes of operation. The second switching circuit 5140 may include a plurality of switches for providing the boosting voltages VB1 and VB2 to each regulator, and for example, the switches may be formed of transistors. Operations of the second switching circuit 5140 in various modes of operation will be more fully described with reference to FIGS. 13A to 13D.

FIGS. 13A to 13D are block diagrams illustrating operations of the display driver integrated circuit 5100 in various modes of operation. For brevity of illustration, the second switching circuit 5140, the regulators 5131, 5132, and 5133, and a power management integrated circuit 5200 are only illustrated in drawings, but the first power supply voltage VS1 to be supplied to the regulators 5131, 5132, and 5133 is not illustrated. As described above, the boosting voltage VB1, the output voltages VO1 and VO2, and the external voltage Vext may be all negative in level, and example embodiments assume that absolute values thereof have the following relationships: $|VB1|>|VB2|$ and $|VO1|>|VO2|>|VO3|$, and $|VO1|>|VO2|>|Vext|$. To help understand, a description will be given with reference to FIGS. 9A and 9B.

Figure 13A:
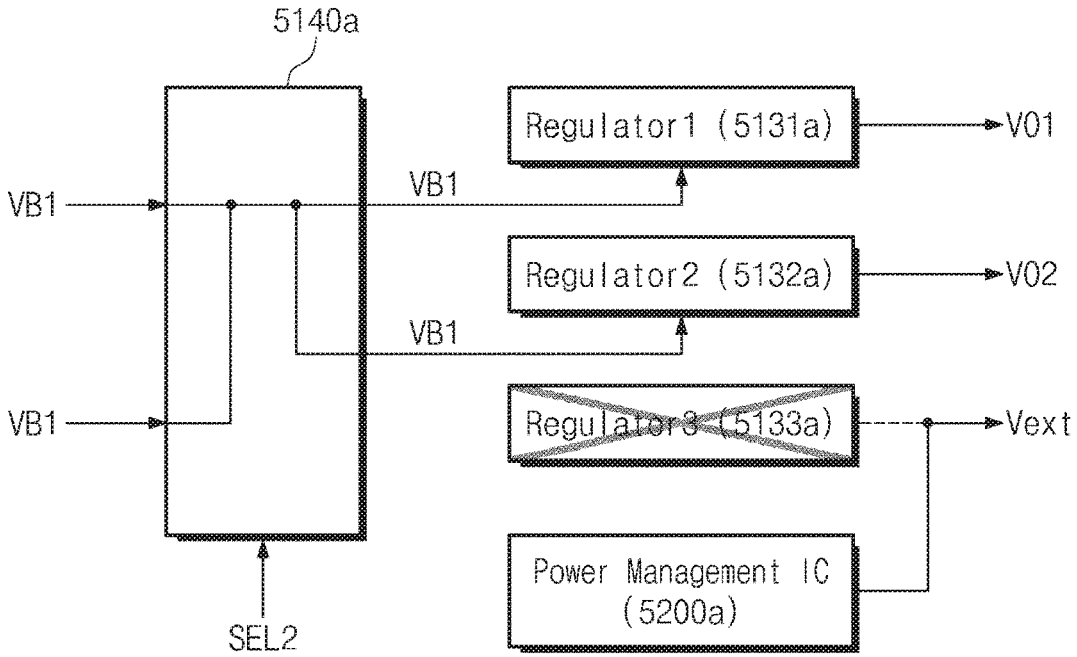
FIGS. 13A to 13D are block diagrams illustrating operations of the display driver integrated circuit in various modes of operation.

Referring to FIG. 13A, in the normal mode, through a switching operation of a second switching circuit 5140*a*, the first boosting voltage VB1 generated by the first booster 5121 and the first boosting voltage VB1 generated by the second booster 5122 may be supplied to first and second regulators 5131*a* and 5132*a*. Since an absolute value of the second output voltage VO2 is smaller than an absolute value of the first output voltage VO1, a voltage drop in the second regulator 5132*a* may be larger than a voltage drop in the first regulator 5131*a*.

The third regulator 5133*a* may not operate in the normal mode. Instead, the voltage Vext sufficient to drive the display panel 1300 may be generated by the external power management integrated circuit 5200*a* of the display driver integrated circuit 5100. An operation in which the power management integrated circuit 5200*a* generates the external voltage Vext may be executed by the controller 5150 or by an external timing controller (not illustrated).

Figure 13B:
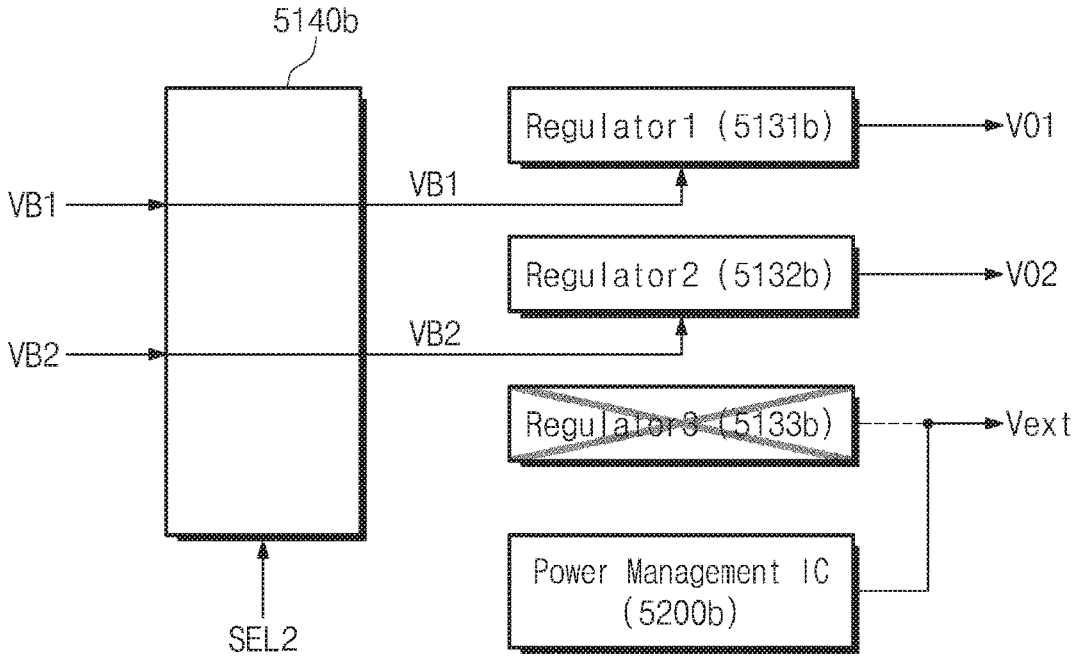

Referring to FIG. 13B, in another normal mode, through a switching operation of a second switching circuit 5140*b*, the first boosting voltage VB1 generated by the first booster 5121 and the second boosting voltage VB2 generated by the second booster 5122 may be respectively supplied to first regulator 5132*a* and the second regulator 5132*a*. Since an absolute value of the second boosting voltage VB2 is smaller than an absolute value of the first boosting voltage VB1, a difference between voltage drops in the first and second regulators 5131*b* and 5132*b* may be smaller than that of the embodiment of FIG. 13A.

Likewise, a third regulator 5133*b* may not operate in the normal mode. Instead, the voltage Vext sufficient to drive the display panel 1300 may be generated by an external power management integrated circuit 5200*b* of the display driver integrated circuit 5100.

Figure 13C:
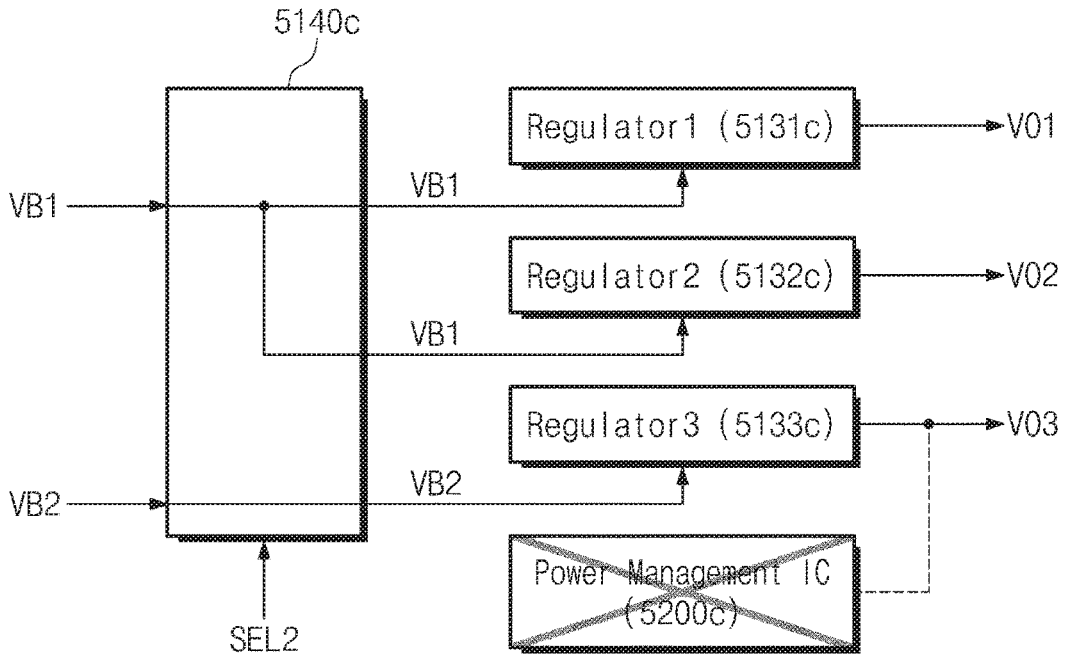

Referring to FIG. 13C, in the low-power mode, through a switching operation of a second switching circuit 5140*c*, the first boosting voltage VB1 generated by the first booster 5121 may be supplied to first and second regulators 5131*c* and 5132*c*, and the second boosting voltage VB2 generated by the second booster 5122 may be supplied to a third regulator 5133*c*. Excessive or undesirable boosting by a booster may be prevented or mitigated because the third regulator 5133*c* is driven by the second boosting voltage VB2 of which an absolute value is relatively small. In addition, since an excessive voltage drop in the third regulator 5133*c* is prevented or mitigated, the performance of the display driver integrated circuit 5100 may be improved.

In the low-power mode, the controller 5150 or an external timing controller (not illustrated) may control a power management integrated circuit 5200*c* such that the power management integrated circuit 5200*c* does not generate the external voltage Vext.

Figure 13D:
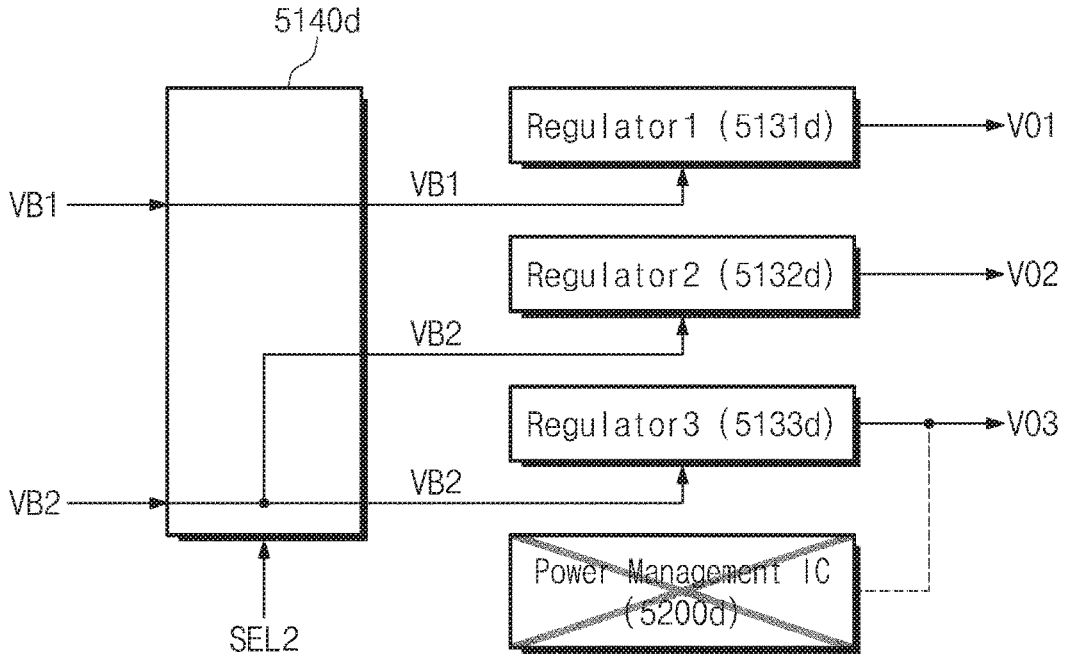

Referring to FIG. 13D, in another low-power mode, through a switching operation of a second switching circuit 5140*d*, the first boosting voltage VB1 generated by the first booster 5121 may be supplied to a first regulator 5131*d*. Also, the second boosting voltage VB2 generated by the second booster 5122 may be supplied to second and third regulators 5132*d* and 5133*d*. Likewise, a power management integrated circuit 5200*d* may be controlled so as not to generate the external voltage Vext.

In the example embodiments described with reference to FIGS. 13A to 13D, the first boosting voltages VB1 supplied to the second switching circuits 5140*a*, 5140*b*, 5140*c*, and 5140*d* may be different from each other, and the second boosting voltages VB2 supplied thereto may be also different from each other. For example, the boosting voltages VB1 and VB2 may be voltages that are boosted based on a power supply voltage(s) appropriately selected from the plurality of power supply voltages VS1 to VSn such that output voltages VO1, VO2, and VO3 of target levels are generated.

The switching operation of the second switching circuit 5140 is described above. Although a detailed configuration of the second switching circuit is not explicitly illustrated, an appropriate element (e.g., a transistor) that supplies a boosting voltage to a regulator may be used. A description is given as the boosting voltages VB1 and VB2 are distributed to three regulators, but technical features of the inventive concepts may be equally applied to the case that four or more regulators are used.

Figure 14:
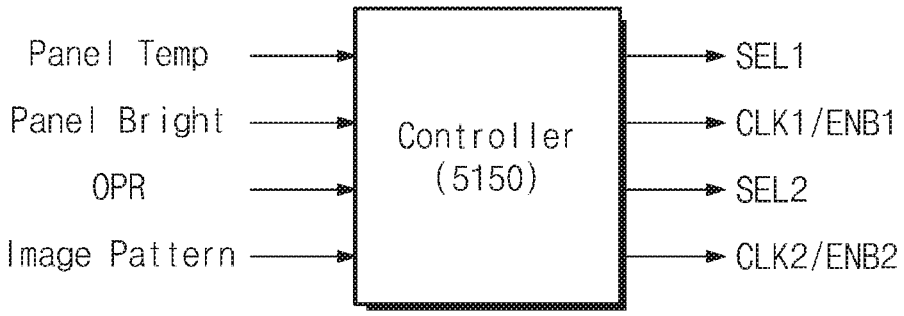
FIG. 14 is a block diagram for describing an operation of a controller illustrated in FIG. 12.

FIG. 14 is a block diagram for describing an operation of a controller illustrated in FIG. 12. For better understanding, a description will be given with reference to FIGS. 12 and 14.

Basically, the controller 5150 may control the display driver integrated circuit 5100 based on a preset or desired setting value. Accordingly, power supply voltages to be supplied to the boosters 5121 and 5122 (refer to FIG. 12) may be set in advance based on the normal mode or various low-power modes. For example, values may be set in advance such that the power supply voltages VS1 and VS2 are supplied to the first booster 5121 in the normal mode and the power supply voltage VSn is supplied to the second booster 5122 in the low-power mode.

However, the preset setting values may be changed if necessary. For example, the preset setting values may be changed when levels of voltages for driving a display panel need to be changed overall due to a very high temperature of the display panel. Accordingly, values that are used to change the preset, or desired, setting values may be sent to the controller 5150 as a feedback. For example, a temperature of the display panel, panel bright, an on pixel ratio (OPR), an image pattern to be output in the display panel, and/or other values may be considered as the feedback.

The controller 5150 may change a setting value for a boosting voltage of each of the regulators 5131, 5132, and 5133 in response to a feedback signal from the display panel. The controller 5150 may calculate power supply voltages that are optimized to generate the newly set boosting voltage. With the above description, the first switching circuit 5110 may perform a switching operation in response to the first selection signal SEL1 that is based on the calculation result of the controller 5150, such that appropriate power supply voltages (e.g., voltages selected from the power supply voltages VS1 to VSn) are supplied to the boosters 5121 and 5122.

For example, example embodiments assume that values are set such that the power supply voltages VS1 and VS2 are supplied to each of the boosters 5121 and 5122. If a temperature of the display panel is very high, as determined based on the feedback signal from the display panel, the controller 5150 may generate the first selection signal SEL1 for controlling the first switching circuit 5110 such that power supply voltages that are different from the power supply voltages VS1 and VS2 are supplied to the boosters 5121 and 5122. To this end, the display panel may include a sensor that measures a temperature of the display panel.

Alternatively or additionally, if that the display panel is very bright is determined based on the feedback signal from the display panel, the controller 5150 may generate the first selection signal SEL1 for controlling the first switching circuit 5110 such that power supply voltages that are different from the power supply voltages VS1 and VS2 are supplied to the boosters 5121 and 5122.

As another example, if that a ratio (i.e., OPR) of white pixels to pixels constituting the display panel exceeds a reference value is determined based on the feedback signal from the display panel, the controller 5150 may generate the first selection signal SEL1 for controlling the first switching circuit 5110 such that power supply voltages that are different from the power supply voltages VS1 and VS2 are supplied to the boosters 5121 and 5122.

As another example, if that an image is displayed in an area of the display panel is determined based on the feedback signal from the display panel, the controller 5150 may generate the first selection signal SEL1 for controlling the first switching circuit 5110 such that power supply voltages that are different from the power supply voltages VS1 and VS2 are supplied to the boosters 5121 and 5122.

Figure 15:
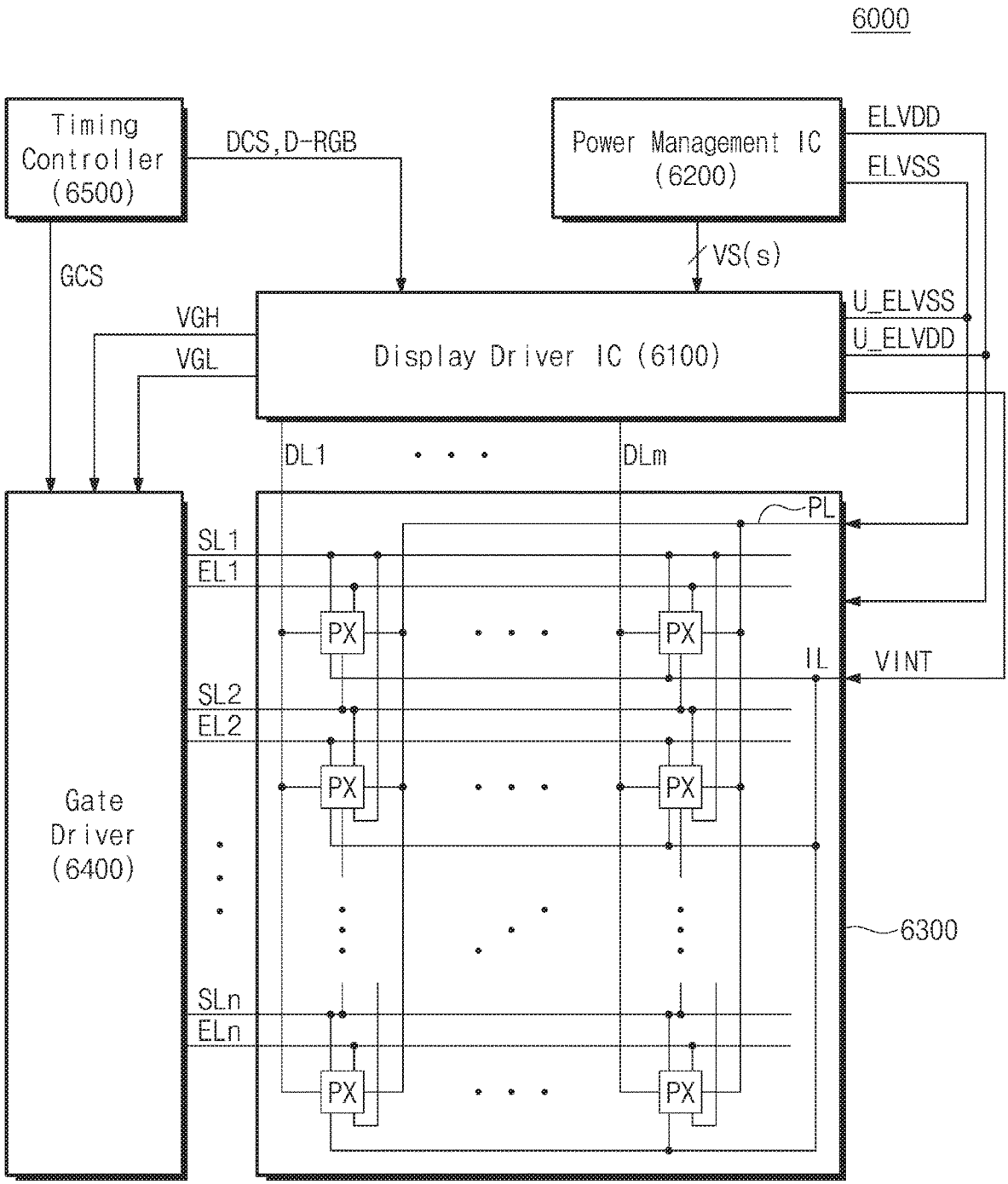
FIG. 15 is a block diagram illustrating a configuration of the electronic device to which the display driver integrated circuit is applied, according to an example embodiment of the inventive concepts.

FIG. 15 is a block diagram illustrating a configuration of an electronic device 6000 to which the display driver integrated circuit 6100 is applied, according to an example embodiment of the inventive concepts. The electronic device 6000 may include the display driver integrated circuit 6100, a power management integrated circuit 6200, a display panel 6300, a gate driver 6400, and a timing controller 6500.

The display driver integrated circuit 6100 may receive a data control signal DCS and image data D-RGB from the timing controller 6500. The display driver integrated circuit 6100 may convert the image data D-RGB into data signals and may output the data signals to data lines DL1 to DLm. The data signals may be analog voltages that respectively correspond to gray scale values of the image data D-RGB.

The display driver integrated circuit 6100 may generate voltages VGH, VGL, VINT, U_ELVDD, and U_ELVSS that are used to drive the display panel 6300. To this end, the display driver integrated circuit 6100 may include a plurality of boosters and a plurality of regulators described in this specification. The display driver integrated circuit 6100 may further include a first selection circuit for selecting power supply voltages to be supplied thereto and a second selection circuit for transferring a boosting voltage to each regulator.

For example, the voltages VGH, VGL, and VINT may be used to drive the display panel 6300 independent of a mode of operation. The voltages U_ELVDD and U_ELVSS may be used to drive the display panel 6300 in the low-power mode. Meanwhile, in the normal mode, the display panel 6300 may be driven by voltages ELVDD and ELVSS generated by the power management integrated circuit 6200, instead of the voltages U_ELVDD and U_ELVSS.

Meanwhile, in the low-power mode, absolute values of the negative voltages VGL, VINT, and U_ELVSS to drive the display panel 6300 may be different from each other. In an example embodiment, power supply voltages may be appropriately selected to improve a boosting efficiency of a booster upon generating the negative voltages VGL, VINT, and U_ELVSS and to reduce power consumption of a regulator, and appropriate boosting voltages may be respectively generated by boosters. For example, the voltage VGL may be generated by the first regulator 5131 of FIG. 12, the voltage VINT may be generated by the second regulator 5132 of FIG. 12, and the voltage U_ELVSS may be generated by the third regulator 5133 of FIG. 12.

The power management integrated circuit 6200 may generate various kinds of power supply voltages VSs (s being an integer of 2 or more) that are used to generate voltages for driving the display panel 6300. For example, the power management integrated circuit 6200 may include a voltage converter (not illustrated) that generates a voltage of which a level is appropriate to drive the display driver integrated circuit 6100. Alternatively, the voltage converter may be provided as an independently separated circuit, not provided in the power management integrated circuit 6200. The power management integrated circuit 6200 may generate the voltages ELVDD and ELVSS that are used to drive the display panel 1300 in the normal mode.

The display panel 6300 may be, for example, an organic light-emitting diode display panel. However, example embodiments of the inventive concepts may not be limited thereto. For example, the display driver integrated circuit 6100 may be applied to various kinds of display panels. A pixel structure when the display panel 6300 is the organic light-emitting diode display panel will be more fully described with reference to FIG. 16.

The display panel 6300 may include scan lines SL1 to SLn, emission lines EL1 to ELn, the data lines DL1 to DLm, and pixels PX.

Each of the emission lines EL1 to ELn may be arranged in parallel to the corresponding scan line of the scan lines SL1 to SLn. The data lines DL1 to DLm may cross the scan lines SL1 to SLn and may be isolated from the scan lines SL1 to SLn.

Each of the pixels PX may be connected to the corresponding one of the scan lines SL1 to SLn, the corresponding one of the emission lines EL1 to ELn, and the corresponding one of the data lines DL1 to DLm.

Each pixel PX may receive the first voltage ELVDD and the second voltage ELVSS, of which a level is lower than that of the first voltage ELVDD, in the normal mode. Each pixel PX may receive the third voltage U_ELVDD and the fourth voltage U_ELVSS in the low-power mode. Each pixel PX may be connected to a power line PL to which the first voltage ELVDD is applied. Each pixel PX may be connected to an initialization line IL for receiving an initialization voltage VINT.

Each pixel PX may be electrically connected to three scan lines. For example, pixels of a second pixel row may be connected to first to third scan lines SL1 to SL3.

Although not illustrated in FIG. 15, the display panel 6300 may further include a plurality of dummy scan lines. The display panel 6300 may further include, for example, a dummy scan line connected to the pixels PX of the first pixel row and a dummy scan line connected to the pixels PX of the n-th pixel row. Also, pixels (hereinafter referred to as "pixels of a pixel column") connected to any one of the data lines DL1 to DLm may be connected to each other. Two pixels, which are adjacent to each other, of the pixel of the pixel column may be electrically connected to each other.

Each pixel PX may include an organic light-emitting diode (not illustrated) and a pixel driver circuit (not illustrated) controlling emission of the organic light-emitting diode. The pixel driver circuit may include a plurality of thin film transistors and a capacitor. At least one of the gate driver 6400 and the display driver integrated circuit 6100 may include thin film transistors that are formed through the same process as the pixel driver circuit.

The scan lines SL1 to SLn, the emission lines EL1 to ELn, the data lines DL1 to DLm, the power line PL, the initialization line IL, the pixels PX, the display driver integrated circuit 6100, and the gate driver 6400 may be formed on a base substrate (not illustrated) by iteratively performing a photolithography process. Insulating layers may be formed on the base substrate (not illustrated) by iteratively performing a deposition process and a coating process. Each insulating layer may include a thin film covering the whole display panel 6300 or at least one insulating pattern overlapping only a specific configuration of the display panel 6300. The insulating layers may include an organic layer and/or an inorganic layer. Besides, a sealing layer (not illustrated) for protecting the pixels PX may be further formed on the base substrate.

The gate driver 6400 may receive a gate control signal GCS from the timing controller 6500. The gate control signal GCS may include a start vertical signal for starting an operation of the gate driver 6400, a clock signal for determining output timing of signals, etc. The gate driver 6400 may generate a plurality of scan signals and may sequentially output the scan signal to the scan lines SL1 to SLn. Also, the gate driver 6400 may generate a plurality of emission control signals in response to the gate control signal GCS and may output the emission control signals to the emission lines EL1 to ELn.

The timing controller 6500 may receive input image signals (not illustrated) and may generate image data D-RGB by converting a data format of the input image signals to be suitable for an interface specification with the gate driver 6400. The timing controller 6500 may output the image data D-RGB and various controls DCS and SCS to the display driver integrated circuit 6100 and the gate driver 6500.

In an example embodiment, scan signals and control signals are illustrated in FIG. 15 as being output from one gate driver 6400. However, example embodiments of the inventive concepts may not be limited thereto. According to an example embodiment, a plurality of scan driver circuits may divide and output the scan signals and may divide and output emission control signals. Alternatively, according to an example embodiment, a driver circuit that generates and outputs the scan signals and a driver circuit that generates and outputs the emission control signals may be separated from each other. Alternatively, according to an example embodiment, the gate driver 6400 may be integrated in the display driver integrated circuit 6100 to constitute one chip.

Figure 16:
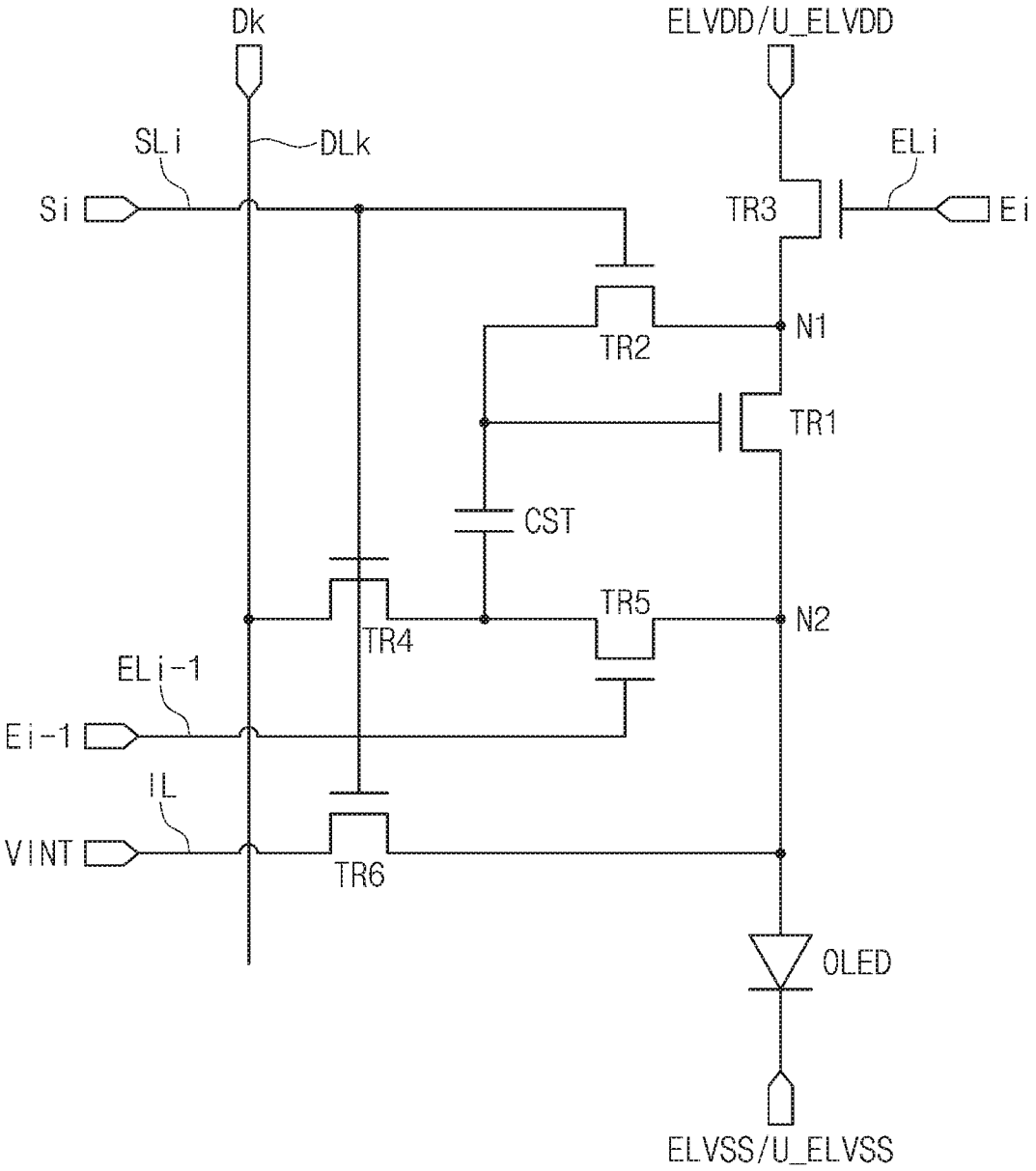
FIG. 16 is an equivalent circuit diagram of a pixel illustrated in FIG. 15.

FIG. 16 is an equivalent circuit diagram of a pixel illustrated in FIG. 15. An equivalent circuit diagram that corresponds to an i-th pixel PXi connected to a k-th data line DLk of the data lines DL1 to DLm is illustrated in FIG. 16.

The i-th pixel PXi may include an organic light-emitting diode OLED and a pixel driver circuit that controls the organic light-emitting diode OLED. A first electrode of the organic light-emitting diode OLED may be connected to a second node N2. A second electrode of the organic light-emitting diode OLED may be connected to the second voltage ELVSS in the normal mode and to the fourth voltage U_ELVSS in the low-power mode. The pixel driver circuit may include six thin film transistors TR1 to TR6 and one capacitor CST. The pixel driver circuit illustrated in FIG. 16 is only an example, and example embodiments of the inventive concepts may not be limited thereto.

The pixel driver circuit may include a driving transistor and a control transistor.

The driving transistor may adjust a driving current that flows to the organic light-emitting diode OLED. For example, the driving transistor may be the first transistor TR1. An output electrode of the first transistor TR1 may be electrically connected with the organic light-emitting diode OLED. The output electrode of the first transistor TR1 may be directly connected to an anode of the organic light-emitting diode OLED or may be connected to the anode thereof through another transistor.

A control electrode of the control transistor may receive a control signal. A control signal to be applied to the i-th pixel PXi may include an i-th scan signal Si, a data signal Dk, an (i−1)-th emission control signal Ei−1, and an i-th emission control signal Ei.

For example, the control transistor may include the second to sixth transistors TR2 to TR6. A description will be given under the condition that the control transistor includes five thin film transistors. However, example embodiments of the inventive concepts may not be limited thereto. For example, the control transistor may be implemented with thin film transistors of which the number is less than 5 or more than 5.

A node between an output electrode of the second transistor TR2 and an input electrode of the first transistor TR1 is defined as a first node N1, and a node between an output electrode of the fifth transistor TR5 and an output electrode of the first transistor TR1 is defined as the second node N2.

The first transistor TR1 may receive the first voltage ELVDD or the third voltage U_ELVDD through the third transistor TR3. The first transistor TR1 may have an input electrode connected to the first node N1, a control electrode connected to one electrode of the capacitor CST, and an output electrode connected to the organic light-emitting diode OLED through the second node N2.

The second transistor TR2 may have a control electrode connected to an i-th scan line Straight line, an input electrode, and an output electrode connected to the first node N1. An input electrode of the second transistor TR2 may be connected to the control electrode of the first transistor TR1 and the one electrode of the capacitor CST.

The third transistor TR3 may have a control electrode connected to an i-th emission control line ELi, an input electrode connected to the power line PL, and an output electrode connected to the first node N1. The third transistor TR3 may be turned on in response to the i-th emission control signal Ei.

The fourth transistor TR4 may have a control electrode connected to the i-th scan line SLi, an input electrode connected to a k-th data line DLk, and an output electrode. The output electrode of the fourth transistor TR4 may be connected to the other electrode of the capacitor CST and the fifth transistor TR5. When the fourth transistor TR4 is turned on by an i-th scan signal Si, the fourth transistor TR4 may provide a data signal received through the input electrode thereof to the capacitor CST.

The fifth transistor TR5 may have a control electrode connected to an (i−1)-th emission control line ELi−1, an input electrode, and an output electrode connected to the second node N2. The input electrode of the fifth transistor TR5 may be connected to the other electrode of the capacitor CST and the fourth transistor TR4. The fifth transistor TR5 may be turned on in response to the (i−1)-th emission control signal Ei−1.

The sixth transistor TR6 may have a control electrode connected to the i-th scan line SLi, an input electrode connected to the initialization line IL, and an output electrode connected to the organic light-emitting diode OLED. When the sixth transistor TR6 is turned on by the i-th scan signal Si, the sixth transistor TR6 may provide the initialization voltage VINT to the second node N2.

Each of the first to sixth transistors TR1 to TR6 may be a P-type transistor or an N-type transistor. An organic light-emitting diode display device may not be limited to any one embodiment and may include various types of transistors.

According to an example embodiment of the inventive concepts, a display driver integrated circuit may generate different levels of boosting voltages based on a mode of operation, thereby preventing unnecessary or excessive boosting.

In addition, the display driver integrated circuit may regulate voltages based on appropriately boosted voltages, thereby reducing power loss due to a regulator.

While the inventive concepts have been described with reference to exemplary example embodiments, it will be apparent to those skilled in the art that various changes and modifications may be made without departing from the spirit and scope of the inventive concepts. Therefore, it should be understood that the above example embodiments are not limiting, but illustrative.

What is claimed is:

1. A display driver integrated circuit configured to operate according to different modes of operation of a plurality of operation modes, the display driver integrated circuit comprising:

a first booster configured to generate, independent of a mode of operation, a first boosting voltage by boosting at least one of first or second power supply voltages;

a second booster configured to generate, according to the different modes of operation, the first boosting voltage or a second boosting voltage by boosting at least one of the first or second power supply voltages;

a first regulator configured to generate a first output voltage based the first boosting voltage generated by at least one of the first or second boosters; and a second regulator configured to generate a second output voltage based on the second boosting voltage.

2. The display driver integrated circuit of claim 1, further comprising:

a first switching circuit configured to provide at least one of the first or second power supply voltages to the first booster and to provide at least one of the first or second power supply voltages to the second booster.

3. The display driver integrated circuit of claim 1, wherein in a normal mode of the plurality of operation modes, at least one of the first or second power supply voltages provided to the first booster is the same as at least one of the first or second power supply voltages provided to the second booster.

4. The display driver integrated circuit of claim 1, wherein in a low-power mode of the plurality of operation modes, at least one of the first or second power supply voltages provided to the first booster is different from at least one of the first or second power supply voltages provided to the second booster.

5. The display driver integrated circuit of claim 1, wherein in a normal mode of the plurality of operation modes, the first regulator is configured to be driven by at least one of the first boosting voltages or the first power supply voltage, and the second regulator is configured not to operate.

6. The display driver integrated circuit of claim 1, wherein in a low-power mode of the plurality of operation modes, the first regulator is configured to be driven by the first boosting voltage generated by the first booster and the first power supply voltage, and the second regulator is configured to be driven by the second boosting voltage and the first power supply voltage.

7. The display driver integrated circuit of claim 1, wherein at least one of the first or second boosters includes a charge pump or a switched mode power supply (SMPS).

8. The display driver integrated circuit of claim 1, wherein at least one of the first or second boosting voltages is a negative voltage, and an absolute value of the first boosting voltage is larger than an absolute value of the second boosting voltage.

9. The display driver integrated circuit of claim 8, wherein at least one of the first or second output voltages is a negative voltage, and an absolute value of the first output voltage is larger than an absolute value of the second output voltage.

10. The display driver integrated circuit of claim 8, wherein each of the first and second boosting voltages is a negative voltage.

11. The display driver integrated circuit of claim 10, wherein each of the first and second output voltages is a negative voltage.

12. The display driver integrated circuit of claim 1, further comprising:

a first switching circuit configured to operate in a normal mode of the plurality of operation modes to provide at least one of the first boosting voltage generated by the first booster or the first boosting voltage generated by the second booster to the first regulator and to provide the second boosting voltage to the second regulator.

13. A display driver integrated circuit configured to operate according to different modes of operation of a plurality of operation modes, the display driver integrated circuit comprising:

a boosting circuit including a first booster and a second booster, the boosting circuit configured to, generate, independent of a mode of operation, a first boosting voltage by boosting at least one of first or second power supply voltages, and according to the different modes of operation, generate the first boosting voltage or a second boosting voltage by boosting at least one of the first or second power supply voltages; and a regulating circuit configured to generate a first output voltage based on the first boosting voltage generated by at least one of the first booster or the second booster and to generate a second output voltage based on the second boosting voltage.

14. The display driver integrated circuit of claim 13, further comprising:

a switching circuit configured to provide at least one of the first or second power supply voltages to the boosting circuit.

15. The display driver integrated circuit of claim 13, wherein at least one of the first or second boosting voltages is a negative voltage, and an absolute value of the first boosting voltage is larger than an absolute value of the second boosting voltage; and at least one of the first or second output voltages is a negative voltage, and an absolute value of the first output voltage is larger than an absolute value of the second output voltage.

16. The display driver integrated circuit of claim 13, wherein the regulating circuit is configured to not generate the second output voltage in the normal mode of the plurality of operation modes.

17. The display driver integrated circuit of claim 13, wherein each of the first output voltage and the second output voltage is a negative voltage.

18. The display driver of claim 13, wherein the regulating circuit is configured to generate the first output voltage based on both the first boosting voltages generated by the first booster and the first boosting voltage generated by the second booster.

19. A display driver integrated circuit comprising:

a boosting circuit including a first booster and a second booster, the boosting circuit configured to generate, independent of a mode of operation, with the first booster, a first boosting voltage by boosting at least one of first or second power supply voltages and to generate, with the second booster, the first boosting voltage or a second boosting voltage by boosting at least one of the first or second power supply voltages; and a regulating circuit configured to generate a first output voltage based on the first boosting voltage generated by at least one of the first booster or the second booster and to generate a second output voltage based on the second boosting voltage, wherein at least one of the first or second boosting voltages is a negative voltage, and an absolute value of the first boosting voltage is larger than an absolute value of the second boosting voltage.

* * * * *